United States Patent [19]

Okumura

[11] Patent Number: 4,619,174

[45] Date of Patent: Oct. 28, 1986

[54] ELECTRONIC MUSICAL INSTRUMENT

[75] Inventor: Takatoshi Okumura, Hamamatsu, Japan

[73] Assignee: Nippon Gakki Seizo Kabushiki Kaisha, Hamamatsu, Japan

[21] Appl. No.: 785,103

[22] Filed: Oct. 7, 1985

Related U.S. Application Data

[63] Continuation of Ser. No. 619,068, Jun. 11, 1984, abandoned, which is a continuation of Ser. No. 367,905, Apr. 13, 1982, abandoned.

[30] Foreign Application Priority Data

| | | | |
|---|---|---|---|
| Apr. 15, 1981 | [JP] | Japan | 56-57701 |
| May 14, 1981 | [JP] | Japan | 56-73251 |
| May 22, 1981 | [JP] | Japan | 56-77670 |

[51] Int. Cl.[4] ..... G10H 1/18; G10H 7/00

[52] U.S. Cl. ..... 84/1.01; 84/DIG. 11

[58] Field of Search ..... 84/1.01, 1.26, DIG. 11

[56] References Cited

U.S. PATENT DOCUMENTS

| | | | |
|---|---|---|---|
| 3,639,913 | 2/1972 | Watson | 84/1.01 X |
| 4,333,374 | 6/1982 | Okumura et al. | 84/1.01 |

*Primary Examiner*—S. J. Witkowski

*Attorney, Agent, or Firm*—Spensley Horn Jubas & Lubitz

[57] ABSTRACT

An electronic musical instrument are provided a plurality of tone production channels to produce musical tones polyphonically. Each of the tone production channel includes a first counter which divides clock pulses by either one of N and N+1 to deliver an output pulse. A second counter and a control circuit are further provided in the instrument, which are commonly used for respective tone production channels. The second counter counts, on the time division basis, the output pulses from the first counters, and the control circuit designates the dividing number of the first counter is relation with the counted value of the second counter. Each of the tone production channels produces a tone signal having a frequency predetermined by the combination of N and N+1. By time divisionally using the second counter and the control circuit, the construction of the instrument is simplified.

20 Claims, 11 Drawing Figures

ELECTRONIC MUSICAL INSTRUMENT

This application is a continuation of application Ser. No. 619,068 filed June 11, 1984 and now abandoned which is a continuation of application Ser. No. 367,905 filed Apr. 13, 1982 and now abandoned.

BACKGROUND OF THE INVENTION

This invention relates to an electronic musical instrument, and more particularly an improvement of an electronic musical instrument of the type wherein a frequency signal representing frequency corresponding to a note name of a depressed key is formed and a musical tone corresponding to the depressed key is produced by utilizing the frequency signal.

As is well known in the art, in many types of electronic musical instruments, a plurality of frequency signals of predetermined frequencies are formed simultaneously. In a first example, a plurality of tone production channels are provided and the tone production of a musical tone relating to depressed keys is assigned to available one or more of the tone production channels. In each tone production channel a plurality of frequency signals are formed corresponding to the tone pitches of the depressed key or keys assigned to the channel. According to a second method, a plurality of frequency signals corresponding to respective note names C through B are provided in advance, and a musical tone is produced by utilizing one or ones relating to the depressed key or keys among these frequency signals.

To this end a system has been proposed wherein a plurality of frequency division channels (a series of frequency dividing circuits) are provided corresponding to respective tone production channels or 12 note names C through B, and the frequency of a clock pulse produced by a main oscillator is divided at a predetermined frequency division ratio in each frequency division channel to produce frequency signals. For example, the first method is disclosed in Japanese Preliminary Patent Publication No. 3257/1978 dated Feb. 4, 1978, and the second method is disclosed in U.S. Pat. No. 3,818,354 dated June 18, 1974.

Since in these prior art systems, each frequency division channel is constituted by a first counter which divides the frequency of the clock pulse at a frequency division ratio determined by a combination of frequency division ratios N and N+1 (N is a positive integer) and a second counter for counting the number of the frequency division operation by the first counter and for transfering or switching the frequency division ratio of the first counter between the ratios N and N+1 according to the number of the frequency division operations, it was necessary to provide two counters for each frequency division channels thereby complicating the construction and enlarging the electronic musical instrument.

In the first method, a frequency number (numerical data) corresponding to the tone pitch of the depressed key is sequentially accumulated and the accumulated value (waveform generating data) is applied to a waveform memory device as an address signal to cause the memory device to produce a musical tone signal corresponding to the tone pitch of the depressed key. With this method, however, the reading out of the musical tone signal waveform from the waveform memory device is initiated just after the completion of the tone production assignment relating to the depressed key. Therefore, where notes relating to keys of the same note of different octaves are assigned to two tone production channels, due to the difference in the depression times of these two keys the musical tone signal waveforms of the two channels would have opposite phases with the result that the tones produced by the two channels will be canceled each other, meaning that a phase difference between tones having the same note name of different octaves distorts the musical tone. The same problem also occurs between keys of the same note name of the upper and lower keyboards.

In the former method, a waveform memory device is used for respective tone production channels, on a time division basis. In this case, since the operating frequency, that is frequency which the specified one of the time division time slots occurs, is set independently of the frequencies of the musical tones to be produced by respective tone production channels, the musical tone signal waveform formed on the time division basis would contain a clock component and a unwanted reflected noise component which not only distorts the waveform but also makes the produced sound unclear.

According to an electronic musical instrument disclosed in U.S. Pat. No. 4,228,403, number of the frequency signals corresponding to note names C through B are counted to form a serial pulse train in which weights of $2^0$ to $2^n$ (n is a positive integer) are assigned to respective note names C through B, the pulse train being produced for discrete note names as frequency divided data (waveform generating data) obtained by sequentially dividing the frequency of the frequency signal by $\frac{1}{2}$. On the utilization side (tone production channels) frequency divided data corresponding to the note name of the depressed key are selected out of a group of frequency divided data for discrete note names, and a one bit signal having a weight corresponding to the octave tone range of the depressed key is selected from the selected frequency divided data so as to utilize the selected one bit signal as a musical tone signal regarding the depressed key.

In the electronic musical instrument of this type no phase difference occurs between notes of the same note name of different octaves or notes of the same note of different keyboards as above described. However, as it is necessary to form the pulse train for each of the note names, it is necessary to provide a number of counters having many stages for forming the pulse trains. Furthermore, in each tone production channel, as it is necessary to receive all frequency divided data groups for discrete note names as inputs and to select one frequency divided data regarding a note name of a musical tone to be produced out of the inputs, it is necessary to use a selector having a large number of input bits thus increasing the scale of the circuit.

SUMMARY OF THE INVENTION

Accordingly a principal object of this invention is to provide an improved electronic musical instrument having a plurality of tone production channels, a small size and simple construction.

Another object of this invention is to provide an improved electronic musical instrument capable of simultaneously forming a plurality of frequency signals having predetermined frequencies by utilizing a plurality of frequency division channels and having a simple construction.

Still another object of this invention is to provide a novel electronic musical instrument having a simple construction and which does not form a phase difference between different octave notes of the same note name, or between different keyboard notes of the same note name.

A further object of this invention is to provide an electronic musical instrument capable of preventing unwanted reflected noise components in addition to the prevention of the phase difference described above.

These objects can be attained by providing a second counter to be used in common for all frequency division channels, on the time division basis.

According to another feature of this invention there are provided an arithmetic operation means including 12 temporary memory positions corresponding to 12 note names C through B of one octave note region for forming, on the time division basis, waveform generating data regarding respective note names, and selection means for deriving out waveform generating data from predetermined ones of the temporary memory positions according to the note name of a musical tone to be produced, thereby producing the musicl tone based on the waveform generating data.

More particularly numerical data corresponding to the note names C through B are accumulated, on the time division basis, by an accumulator for respective note names to form an accumulated values each consisting of a plurality of bits having weights of $2^0$ through $2^n$, and one accumulated value corresponding to the note name of the musical tone to be formed among the accumulated values for respective note names is derived out, as the waveform generating data, from a predetermined memory position of the accumulator.

Alternatively, the number of a note clock signal (frequency signal) having a frequency corresponding to one of the 12 note names C through B is counted on the time division basis to form a count consisting of a plurality of parallel bits having weights of $2^0$ through $2^n$, and a count corresponding to the note name of the music tone to be formed is derived out as the waveform generating data from a predetemined memory position among the counts for respective note names.

Let us consider that a bit signal having a weight $2^0$ among various bit of the waveform generating data is the bit signal having the highest octave note region. Then a bit signal having a weight of $2^n$ is the bit signal related to a note region spaced n octaves.

More particularly, it is possible to simultaneously derive out note name signals for respective note names over n octave note regions. Consequently, where such waveform generating data are utilized for a plurality of tone production channels, it is sufficient to connect only n bit signal lines for each tone production channel, and even when the tone production assignment of the keys regarding the same note name of different octaves is made to two tone production channels, these channels will be constructed to select one bit out of the same waveform generating data having n bits corresponding to the octave note range of the depressed key so that no phase difference would be formed between different octave notes of the same note name.

According to another feature of this invention, waveform generating data regarding all keys of a plurality of octaves are preformed, a waveform generating data regarding a desired key of a specific tone production channel is selected from the preformed waveform generating data, and the selected waveform generating data are used for producing a musical tone signal. Furthermore, for the purpose of eliminating unwanted reflected noise components, prior to the application of the musical tone wave data of respective tone production channels generated by utilizing the selected waveform generating data of a sound system, the musical tone waveform data is sampled with a signal having a frequency of an integer multiple of the frequency of the musical tone waveform data. To simplify the construction, the circuit elements for forming the musical tone waveform data are used in common, on the time division basis, by respective tone production channels so as to provide only circuit elements which resample the musical tone waveform data for respective tone production channels.

According to one aspect of this invention there is provided an electronic musical instrument of the type including a plurality of frequency division channels, each channel dividing a frequency of a clock pulse for producing a frequency signal having a predetermined frequency, and a musical tone is produced by utilizing the frequency signal, characterized in that there are provided a plurality of frequency dividing means each provided for one of the frequency division channels for dividing the frequency of the clock pulse at a frequency division ratio of N or N+1, where N is a positive integer; means for setting the frequency division ratio N or N+1 for each frequency dividing means in accordance with the frequency of the frequency signal to be produced in each frequency division channel and for setting a mode of combining the frequency division ratios N and N+1 in one frequency division cycle of each of the frequency dividing means; time division counting means for counting, on the time division basis, a number of the frequency divided signals outputted from each of the frequency division channels as a frequency division number signal; control means for controlling switching the frequency division ratio of each of the frequency dividing means between N and N+1 in accordance with an information representing the mode of combining the frequency division ratios N and N+1 set by the setting means and regarding each of the frequency division channels and a frequency division count regarding each of the frequency division channels; and means for utilizing a predetermined bit signal of the frequency divided signal or a count of the frequency division numbers as the frequency channels.

According to another aspect of this invention there is provided an electronic musical instrument comprising arithmetic operation means having 12 temporary memory positions for forming waveform generating data regarding note names of a musical tone to be produced on the time division basis, selecting means for deriving out the waveform generating data corresponding to the note names from predetermined ones of the temporary memory positions, and means for producing the musical tone data derived out by the selecting means.

According to another aspect of this invention there is provided an electronic musical instrument comprising arithmetic operation means having 12 temporary memory positions corresponding to respective note names for forming, on the time division basis, waveform generating data regarding respective note names of a plurality of octave note regions; first selection means for deriving out waveform generating data corresponding to the note names of a musical tone to be produced from predetermined ones of the temporary memory positions; a second selection means for deriving waveform generating data corresponding to an octave region of the musical tone to be produced out of the waveform generating data outputted from the first selection means; and means for producing the musical tone based on the waveform generating data outputted from the second selection means.

According to still other aspect of this invention there is provided an electronic musical instrument of the type including a plurality of tone production channels corresponding to a number of highest tones which are produced simultaneously and producing a musical tone by assigning tone production of a musical tone regarding depressed keys to one of the tone production channels, characterized by comprising arithmetic operation means for forming waveform generating data for respective note names each constituted by a plurality of bits, the waveform generating data respectively varying at speeds corresponding to respective note names; note name selection means for deriving out, for respective tone production channels, waveform generating data corresponding to note names of keys assigned to the tone production channels from the waveform generating data for respective note names formed by the arithmetic operation means; octave control means for controlling the waveform generating data of respective tone production channels outputted from the note name selection means in accordance with octave note regions of the keys assigned to respective tone production channels; wave form data generating means for producing, on the time division basis, musical tone waveform data for respective channels based on the waveform generating data for respective tone production channel outputted from the octave control means; amplitude setting means for setting, on the time division basis, an amplitude based on a desired envelope data for musical tone waveform data of respective tone production channels produced by the waveform generating means; sampling and holding means for sampling and holding the musical tone waveform data of respective tone production channels, the musical tone waveform data having been set with the amplitude, according to predetermined bits of the waveform generating data regarding the same note names as the musical tone forming means; and means for producing outputs of the sampling and holding means as musical tones of respective tone production channels.

BRIEF DESCRIPTION OF THE DRAWINGS

These and further objects and the advantges of the invention can be more fully understood from the following detailed description taken in conjunction with the accompanying drawings in which.

DESCRIPTION OF THE PREFERRED EMBODIMENT

Figure 1:
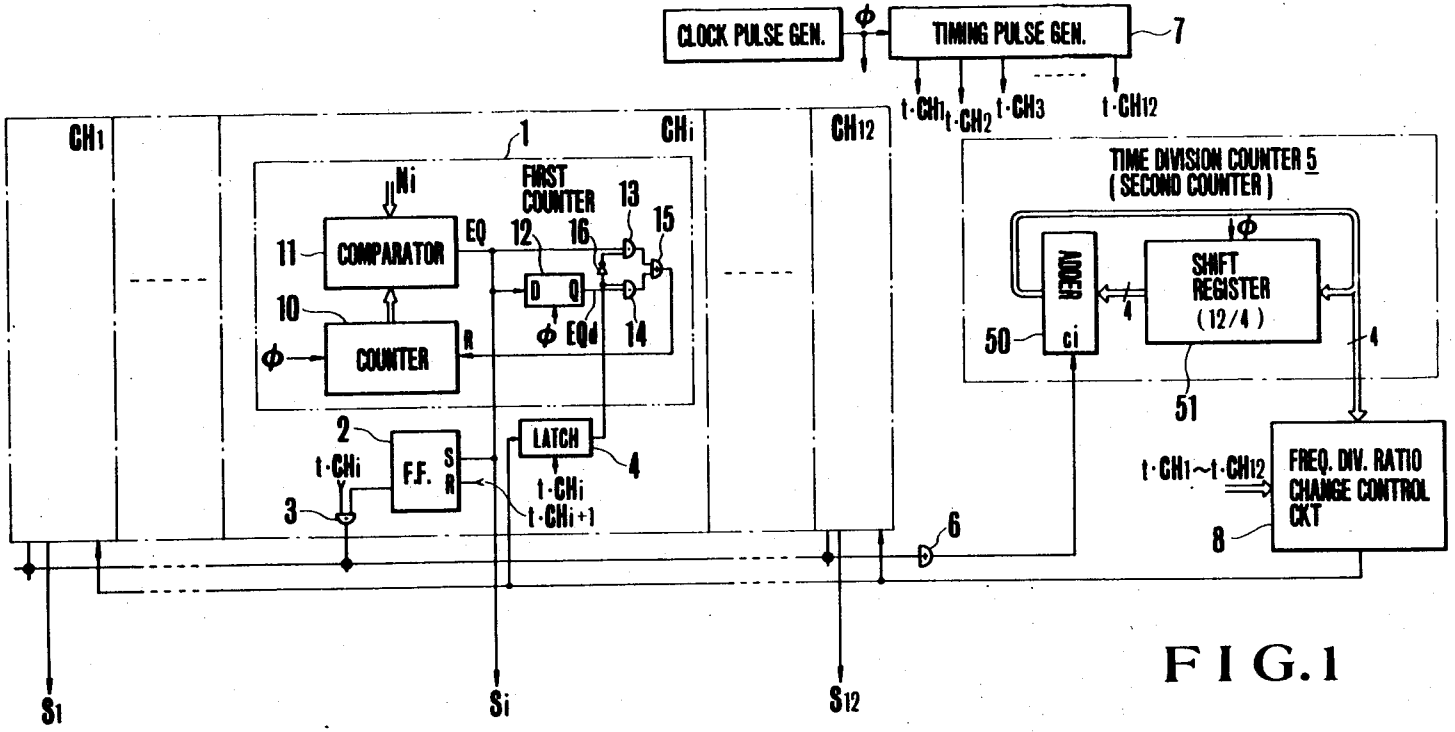
FIG. 1 is a block diagram showing a basic construction of an electronic musical instrument embodying the invention.

FIG. 1 shows the basic construction of the electronic musical instrument of this invention. As shown, there are provided 12 frequency division channels CH 1 . . . CHi . . . and CH12 for effecting frequency divisions at a frequency division ratio determined by a combination of frequency division ratios of positive integers N and N+1 so as to produce frequency signals S1 . . . Si . . . and S12 from these frequency division channels CH1 . . . CHi . . . and CH12 respectively.

In FIG. 1 only one channel CHi of these 12 frequency division channels is shown in detail but other channels have the same construction. A first counter 1 divides the frequency of a clock pulse P produced by a clock pulse generator according to a combination of the frequency division ratios of positive integers Ni and Ni+1. The first counter 1 comprises a frequency division counter 10, a comparator 11, a delay flip-flop circuit 12, AND gate circuits 13 and 14, an OR gate circuit 15 and an inverter 16. The frequency division circuit 10 counts the number of clock pulses $\phi$ and applies its count to one input A of the comparator 11 which detects the fact that the count of the frequency division counter 10 coincides with a value corresponding to a frequency division ratio Ni or not. Thus, data showing the frequency division ratio Ni corresponding to the frequency of a frequency signal Si to be generated in the frequency division channel CHi is applied to the other input B of the comparator 11. Consequently, when the count of the counter 1 coincides with the value corresponding to the frequency ratio Ni, the comparator 11 produces a coincidence signal EQ which passes through the AND gate circuit 13 when the input signal to the inverter 16 is "0", pass through the OR gate circuit 15 and is applied to the frequency division counter 10 as a reset signal R. As a consequence, as long as the input signal to the inverter 16 is "0", the frequency division counter 10 is reset each time a coincidence signal EQ is generated. For this reason, the count of the frequency division counter 10 varies in a range of from 0 to Ni so that the frequency fi of the coincidence signal EQ is (fo)×]1/(Ni)[ where fo represents the frequency of the clock pulse $\phi$. On the other hand, when the input signal to the inverter 16 is "1", the AND gate circuit 13 becomes disabled to enable the other AND gate circuit 14 with one input supplied with the same signal as the input to the inverter 16. To the other input of the AND gate circuit 14 is applied a coincidence signal EQ produced by the comparator 11 delayed by one bit time (one period of the clock pulse $\phi$) by the delay flip-flop circuit 12. The output signal of the AND gate circuit 14 is supplied as the reset signal R to the frequency division counter 10 via the OR gate circuit 15. Thus, the frequency division counter 10 is reset one bit time later than the time of the generation of the coincidence signal EQ according to the frequency division ratio Ni. Accordingly, the count of the frequency division counter 10 varies between 0 to Ni+1. Thus, even if the frequency division data inputted to the comparator 11 is Ni, the frequency fi of the coincidence signal EQ outputted from the comparator 11 is (fo)×1/(Ni+1). As a consequence, by suitably varying the input signal to the inverter 16, it is possible to produce a frequency divisioned output signal Si having a frequency ratio of Ni or Ni+1 by using the coincidence signal EQ from the comprator 11 as a frequency divided output signal.

The frequency division circuits CH1 through CH12 are constructed to complete one frequency division cycle by executing m times the frequency division operation according to the combination of the frequency division ratios N and N+1 and to repeat this frequency division cycle. Assume now that m=16, that frequency division operation at the frequency division ratio N is executed once in each frequency division cycle, and that the frequency division operation at the frequency division ratio N+1 is executed 15 times. Then the clock pulse $\phi$ is frequency a frequency divided [(N×1+N+1)×15] times in each frequency division cycles.

A time division counter 5 is provided to count the number of the frequency division operations in one frequency division cycle in each one of the frequency division channels CH1 through CH12 and the counter 15 is constituted by an adder 50, and a shift register 51 to count the number of the frequency division operations of each of the channels CH1 through CH12, on the time division basis. The counting of the number of the frequency division operations is accomplished by counting the number of the frequency divisioned output signals S1 through S12 of respective frequency division channels CH1 through CH12 with reference to respective channels. More particularly, the shift register 51 of the time division counter 5 has 12 stage memory positions corresponding to 12 frequency division channels CH1 . . . CHi . . . and CH12, so as to apply to the adder 50 the number of the frequency divided output signals S1 through S12 stored at respective stages up to the present for respective frequency division channels CH1 through CH12 according to the clock pulse $\phi$ thereby updating or renewing the counted number of the frequency division operations according to newly generated frequency divided output signals S1 through S12 inputted to a carry input terminal Ci of the adder 50. The count of the frequency division operations is repeated in a range of 0 through m−1. The counting timing of the time division operations for respective time division channels at the time division counter 5 periodically appears at a period equal to 12 times of one period 1/fo of the clock pulse $\phi$. The timings of generation of the frequency divided output signals S1 through S12 of respective frequency divisin channels CH1 through CH12 are determined by the frequency division ratio N or N+1 and these timings are not synchronous with the timing of counting operation of the time division counter 5.

Consequently, the frequency divided output signals S1 through S12 respectively produced at the frequency division channels CH1 through CH12 are synchronized with the count timing of respective channels for the time division counter 5 by an output circuit including flip-flop circuit 2 and AND gate circuit 3 and then applied to the counter 5. Taking the frequency division channel CHi as an example, the coincidence signal EQ, that is the frequency divided output signal Si is temporarily stored in the flip-flop circuit 2. Then, when a signal t·CHi representing the timing of counting the number of time division operations corresponding to that frequency division channel CHi is generated, the coincidence signal EQ temporarily stored in the flip-flop circuit 2 is outputted through the AND gate circuit 3 in synchronism with the timing of counting the number of time division operations corresponding to the channel CHi for the time division counter 5. Also the coincidence signal EQ is applied to the carry input Ci of the adder 50 through the OR gate circuit 6. Subsequently, when a signal CHi+1 representing the timing of counting the number of the time division operations corresponding to the next frequency division channel CHi+1 is generated, the flip-flop circuit 2 is reset.

Signals t·CH1 through t·CH12 representing the timings of counting the number of the time division operations (hereinafter called channel timings) respectively corresponding to frequency division channels CH1 through CH12 are formed in a timing pulse generator 7 in accordance with the clock pulse $\phi$. Signals t·CH1 through t·CH12 are perfectly in synchronism with channel timings of the frequency division channels CH1 through CH12.

The output of the shift register 51 of the time division counter 5, that is the counted number of the frequency division operations according to a combination of the frequency division ratios N and N+1 of respective frequency division channels CH1 through CH12 is applied to a frequency division ratio change control circuit 8.

The frequency ratio change control circuit 8 controls the frequency division ratio of respective frequency division channels CH1 through CH12 to N or N+1 in accordance with the number of the frequency division operations of the frequency division channels. More particularly, the frequency division ratio change control circuit 8 outputs, on the time division basis, a frequency division ratio control signal for each frequency division channel based on the data representing the number of the frequency division operations regarding each one of the frequency division channels CH1 through CH12 and outputted from the time division count 5 on the time division basis. The frequency division ratio control signal becomes "1" at a time when the frequency is to be divided at a ratio of N+1 among m times frequency division operations and is preprogrammed for each of the frequency division channels CH1 through CH12.

The frequency division ratio change control circuit 8 is provided for each frequency division channels and each comprises a plurality of memory elements storing the frequency division ratio control signal of "1" which is programmed according to a mode of combining the frequency dividing operations at a frequency division ratio of N and N+1 in each of the frequency division channels. One of the memory elements is enabled, on the time division basis, with channel timing signals t·CH1 through t·C12 and the counted number of the frequency divisions is applied to the enabled memory element as an address signal to produce a preprogrammed frequency division control signal of "1" in accordance with the counted number of the frequency division operations.

The frequency division ratio control signal for each of the frequency division channels CH1 through CH12 outputted, on the time division bases, in synchronism with each channel timing from the frequency division ratio transfer control circuit 8 is applied to a latch circuit 4 of each of the frequency division channels CH1 through CH12. The latch circuit 4 latches the frequency division ratio control signal regarding a channel in accordance with a channel timing signal (one of t·CH1 through t·CH12) corresponding to the associated channel. The frequency division ratio control signal latched by the latch circuit 4 is sent to one input of the AND gate circuit 14 and the inverter 16 of the first counter 1 to set the frequency division ratio of the first counter 1 to N or N+1.

To have more clear understanding a concrete example will be described. It is assumed that the frequency division channel CHi divides the frequency as shown in the following Table I.

TABLE I

| frequency division channel | total number of frequency division ratios | construction of frequency division ratios in one frequency division cycle counted values of the numbers of frequency division operations | | | | | | | | | | | | | | | |
|---|---|---|---|---|---|---|---|---|---|---|---|---|---|---|---|---|---|
| | | 0 | 1 | 2 | 3 | 4 | 5 | 6 | 7 | 8 | 9 | 10 | 11 | 12 | 13 | 14 | 15 |
| CHi | Ni × 13 + (Ni + 1) × 3 | Ni | Ni | Ni | Ni | Ni + 1 | Ni | Ni | Ni | Ni + 1 | Ni | Ni | Ni | Ni + 1 | Ni | Ni | Ni |

As shown in this table, in the frequency division channel CHi, a frequency division operation at a frequency division ratio Ni is performed 13 times in one frequency division cycle, and a frequency division operation at a frequency division ratio of Ni+1 is performed 3 times. The number of the frequency division operations in one frequency division cycle is 16. As it is advantageous to uniformly perform the frequency division operations at the ratio of Ni+1 in one frequency division cycle, in the example shown in Table I, at the 5th, 9th and 13th frequency divisions (the counted values of the numbers of frequency division operations 4, 8 and 12), the frequency divisions are performed at a rate of Ni+1. In accordance with the number the frequency division operations regarding the frequency division channel CHi outputted from the time division counter 5, the frequency division ratio transfer control circuit 8 produces a frequency division ratio control signal "0" utilized to cause the frequency division channel CHi to divide the frequency at a ratio of Ni while the data is 0 through 3. When the frequency division number data becomes 4, the frequency division ratio transfer control circuit 8 produces a frequency division ratio control signal "1" for effecting a frequency division operation at a ratio of Ni+1. When the frequency division number data are 5 to 7, 9 to 11 and 13 to 15, a frequency division ratio control signal for effecting a frequency division operation at the ratio of Ni is produced, but when the data are 8, and 12, a frequency division control signal for effecing the frequency division operation at the ratio of Ni+1 is produced. These frequency division ratio control signals are produced in synchronism with the channel timing of the frequency division channel CHi and latched by the latch circuit 4 of the frequency division channel CHi at the time of producing a channel timing signal t·CHi and then supplied to the inverter 16 and the AND gate circuit 14 of the first counter 1. Accordingly, the frequency division ratio of the frequency division channel CHi is switched between Ni and Ni+1 in accordance with the number of the frequency division operations, thus producing frequency division output signals (frequency signals) Si having a frequency obtained by dividing a clock pulse $\phi$ with 1 [Ni×13+(Ni+1)×3] in one frequency division cycle.

As above described, since the circuit elements that control the transfer of frequency division ratios of respective frequency division channels CH1 through CH12 are used commonly, on the time division basis, it is possible to simplify the circuit construction.

Figure 2:
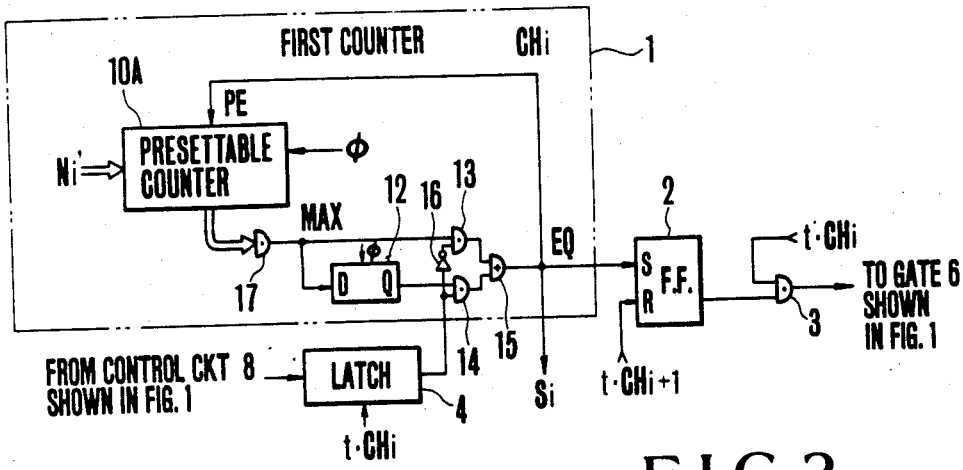
FIGS. 2 and 3 are connection diagrams showing modifications of the first counter shown in FIG. 1.

As shown in FIG. 2, the comparator 11 may be omitted from the first counter 1 where a presettable counter 16 is utilized.

Figure 3:
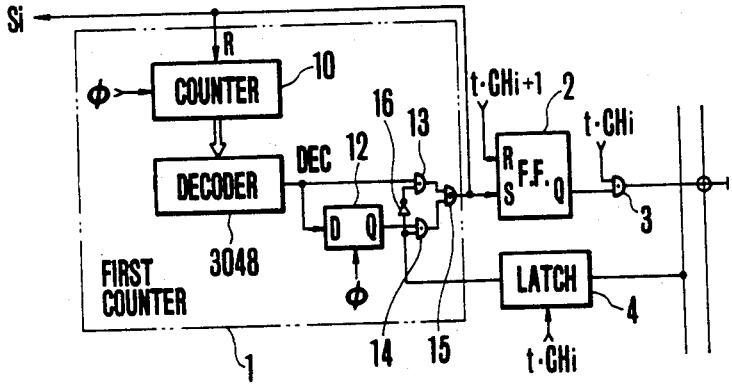

Denoting the maximum frequency division ratio that can be obtained by the preset counter 16 by n, a frequency division ratio data Ni' represented by n−Ni=Ni' is preset in the presettable counter 16. Thereafter, the counter 16 counts the number of the clock pulses $\phi$ starting from the frequency division ratio data Ni', thus setting to increase its count. Then, an instant at which the count of the counter 16 reaches a maximum value (all bits are "1") becomes to correspond to one period when the frequency of the clock pulse $\phi$ is divided at a ratio of Ni. This maximum count is detected by the AND gate circuit 17 and the maximum detected signal MAX is delayed by one bit time by the delay flip flop circuit 12 according to the frequency division ratio control signal from the frequency division ratio transfer control circuit 8. The delayed and not delayed signals are applied to the preset counter 16 to act as a preset enabling signal PE via AND gate circuits 13 or 14 and OR gate circuit 15 in the same manner as in FIG. 1. This enabling signal PE presets again the frequency division data Ni' in the preset counter 16. Then, it is possible to obtain a frequency divisioned output signal (frequency signal) Si, in the same manner as in FIG. 1. In FIG. 2, elements corresponding to those shown in FIG. 1 are designated by the same reference numerals. The first counter 1 shown in FIG. 1 may be constructed as shown in FIG. 3. More particularly, a decoder 3048 is substituted for the comparator 11 shown in FIG. 1 for producing a decoded signal DEC which shows that the count of the counter 10 has reached the frequency division ratio of Ni. Then the decoded signal DEC will be equivalent to the coincidence signal EQ outputted from the comparator 11 shown in FIG. 1. Thus, it is possible to obtain a frequency divided output signal (frequency signal) S' in the same manner as in FIG. 1. The frequency division ratios of respective frequency division channels CH1 through CH12 are not equal, the counts of the counter 10 outputted from the decoder 3048 as the decoded signals DEC are not equal. In FIG. 3 elements corresponding to those shown in FIG. 1 are designated by the same reference numerals. In FIGS. 1, 2 and 3, where the frequency division channels CH1 through CH12 are made to correspond to respective tone production channels (in the case of the first method), the data representing the frequency division ratio Ni and Ni+1 or Ni' and Ni'−1 and the contents of the frequency division ratio control signals are set corresponding to the tone pitches of depressed keys assigned in accordance with a tone production assignment signal produced by a key assignor, whereas when the frequency division channels CH1 through CH12 are made to correspond to respective note names of C, C#, D, D#, E, F, F#, G, G#, A, A# and B (in the case of the second method), the frequency division ratios and the contents of the frequency division ratio control signals are set according to the frequencies of the note names.

Figure 4:
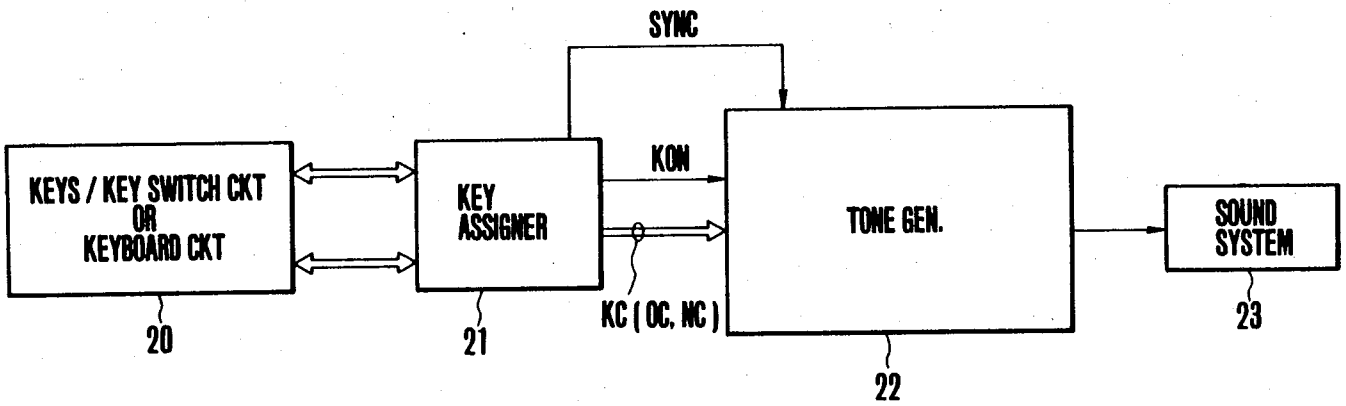
FIG. 4 is a block diagram showing principal circuit elements of the electronic musical instrument according to this invention.
Figure 5:
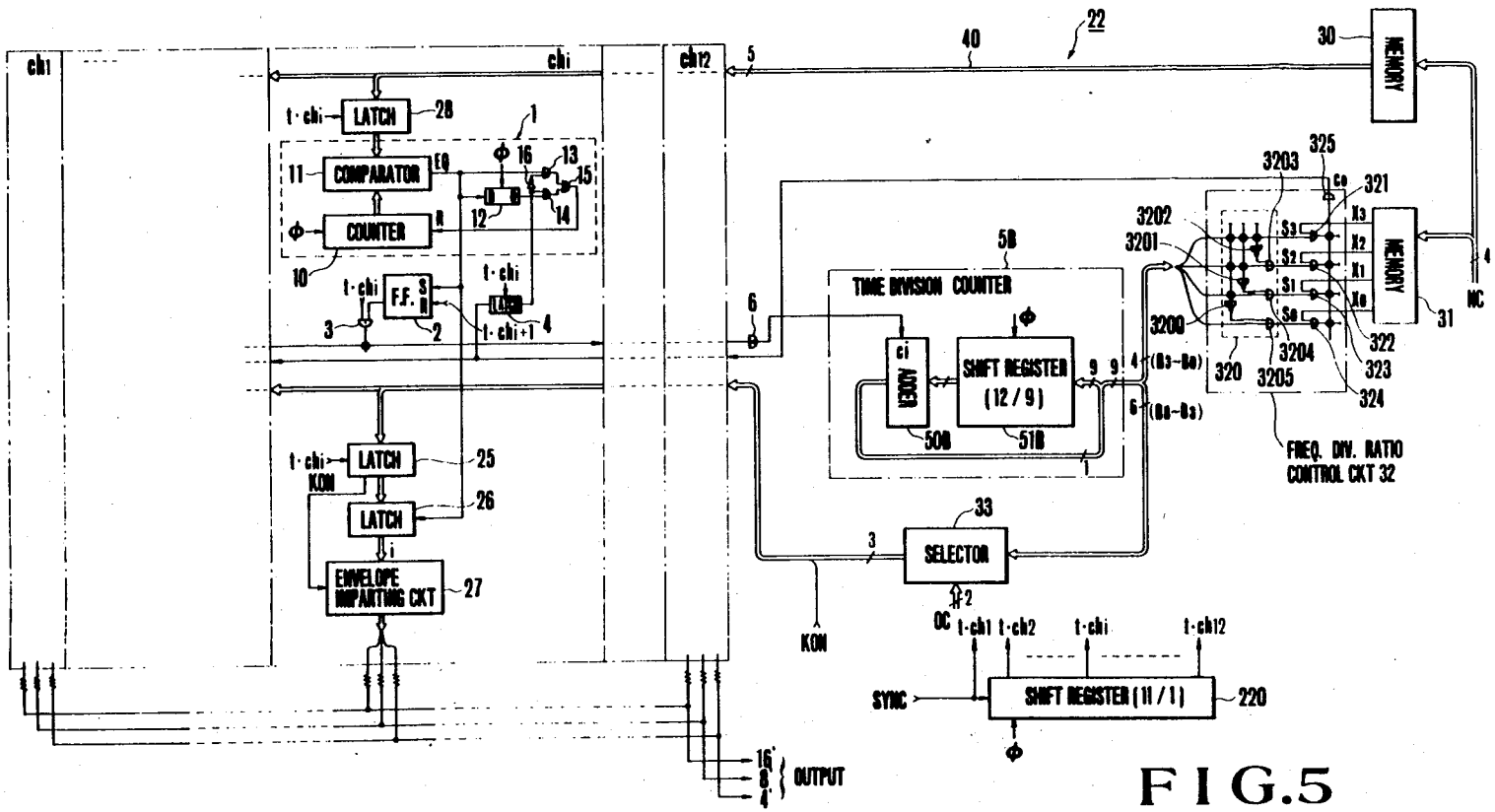
FIG. 5 is a connection diagram showing the detail of the tone generator shown in FIG. 4.

FIG. 4 is a block diagram showing the entire construction of an electronic musical instrument in which the frequency division channels CH1 through CH12 described above are applied to tone production channels of a tone generator of the electronic musical instrument, and FIG. 5 is a block diagram showing the construction of the tone generator shown in FIG. 4 in which there are provided 12 tone production channels ch1 through ch12 on the assumption that the maximum number of tones which are to be produced simultaneously is 12.

A keyboard circuit 20 shown in FIG. 4 is provided with a plurality of key switches corresponding to respective keys and operated when associated keys are operated. The operations of the keys are detected by a key assignor 21. The key assignor 21 detects any one of the depressed keys by the operating states of the key switches and assigns the tone production of a musical tone corresponding to the detected depressed keys to either available one or ones of the tone production channels ch1 through ch12. As a result of this tone production assignment, the key assignor 21 produces, on the time division basis, key data (key codes) KC representing the depressed keys assigned to respective tone production channels ch1 through ch12 in synchronism with respective channel timings. Each key code KC is made up of a note code NC representing the note name of a depressed key and an octave code OC representing an octave note range. The key assignor 21 produces a key-on signal KON ("1" when a key is depressed, whereas "0" when the key is released) representing whether a key assigned to each of the tone production channels ch1 through ch12 is now being depressed or not, on the time division basis, in synchronism with each channel timing. Further, the key assignor 21 repeatedly produces a synchronizing signal SYNC at a timing corresponding to the tone production channel ch1 among channel timings respectively corresponding to the tone production channels ch1 through ch12. The key codes KC, key-on signals KON and the synchronizing signal SYNC are supplied to a tone generator 22.

The tone generator 22 arranges in parallel the key code KC and the key-on signal KON regarding each one of the tone production channels ch1 through ch12 and supplied from the key assignor 21 on the time division basis for each channel in accordance with the synchronizing signal SYNC so as to form a tone source signal (musical tone signal) corresponding to a depressed key assigned to a given tone production channel in each one of the tone production channels ch1 through ch12 based on the key code KC and the key-on signal KON. The tone source signals formed by respective channels ch1 through ch12 of the tone generator 22 are supplied to a tone color circuit, not shown, of a sound system 23 to apply a suitable color to the produced musical tone.

Since the key assignor which operates in a manner as above described is disclosed in U.S. Pat. Nos. 3,882,751 or 3,981,217 it will not be described herein in detail.

FIG. 5 shows one example of the detail of the tone generator 22 which is constructed similarly to that shown in FIG. 1. That is, the frequency division channels CH1 through CH12 shown in FIG. 1 constitute the tone production channels ch1 through ch12 shown in FIG. 5. Since the tone production channels ch1 through ch12 have the same construction, only the channel chi is shown in detail. Similar to the frequency division channels CH1 through CH12 shown in FIG. 1, the channel chi comprises a first counter 1 which forms a frequency signal (hereafter called note name frequency signal) corresponding to the note name of a key assigned to a given channel by the first counter 1. The frequency of the note name frequency signal formed by the first counter 1 is reduced to ½ a plurality of times to be converted into a note name frequency signal corresponding to each octave. In the embodiment shown in FIG. 5, the ½ frequency division, that is the octave frequency division of the note name frequency signals of respective tone production channels ch1 through ch12 is made by utilizing the counting operation of a time division counter 5B (corresponding to the time division counter 5 shown in FIG. 1) which counts, on the time division basis, the number of generations (the number of frequency divisions of the first counter 1) of the note name frequency signals produced at respective channels ch1 through ch12. The count of the time division counter 5B increases by 1 each time a note name frequency signal is produced by the first counter 1. Accordingly a signal at the second bit from the least significant bit of the count corresponds to a signal obtained by decreasing the frequency of the note name frequency signal to ½. In the same manner, a k bit signal corresponds to a signal obtained by reducing the frequency of a note name frequency signal to $1/2^K$. As above described the counts in respective tone production channels ch1 through chi of the time division counter 5B are utilized as the note name frequency signals of respective octaves regarding the note names of the keys assigned to respective tone production channels ch1 through ch12, so that frequency signals (hereafter called tone source frequency signals) corresponding to the tone pitches of the keys assigned to respective tone production channels ch1 through ch12 are obtained by selecting predetermined bit signals among the counts of the tone production channels ch1 through ch12 in accordance with the octaves of the keys assigned to respective tone production channels ch1 through ch12.

The formation of the tone source frequency signals of the tone production channels ch1 through ch12 based on the count of the time division counter 5B is executed on the time division basis for respective tone production channels ch1 through ch12 in synchronism with the time divisioned operation of the counter 5B. Since the time division operation is quite independent of the frequencies of the tone source frequency signals (tone pitch frequencies of the key assigned to respective keys) to be formed in respective tone generation channels ch1 through ch12, a clock component is considered to be contained in the tone source frequency signals of respective tone production channels ch1 through ch12 which are formed on the time division basis with the result that reflected noise components which distort the musical tone to be produced and render it not clear are contained in it.

Accordingly, the tone generator 22 shown in FIG. 5 is constructed to eliminate these defects. More partricularly, each tone source frequency signal formed, on the time division basis, in each of the tone production channels ch1 through ch12 is sampled and held with a frequency which is an integer multiple of the tone source frequency signal in each channel to convert it into a not time divisioned continuous signal. With this construction, the sampling period for producing the continuous signal harmonizes with the pitch of the musical tone with the result that reflected noise components which distort the musical tone are not produced. As a control signal for the sampling and holding is used a note name frequency signal outputted from the first counter 1, and for effecting the sampling and holding, latch circuits 25 and 26 are provided for each of the tone production channels ch1 through ch12.

The tone generator 22 shown in FIG. 5 will now be described in detail, in which elements identical to those shown in FIG. 1 are designated by the same reference characters.

A note code NC of the key code KC representing a depressed key outputted from the key assignor 21 shown in FIG. 4 on the time division basis and assigned to one of the tone production channels ch1 through ch12 is applied to the address signal input terminals of memory devices 30 and 31. The memory device 30 has addresses corresponding to 12 note names C through B, each address storing data representing the frequency division ratio N of each note name, for example data as shown in the following Table II. In the same manner, the memory device 31 has addresses corresponding to the note names C through B, each address storing data representing the number of frequency division operations at a ratio of N+1 corresponding to each note name, for example data as shown in Table II, in which the number of frequency division operations in one frequency division cycle is 16 for each note name. The data stored in these memory devices 30 and 31 can be read out by applying a note code NC representing a note name as an address signal. As a consequence, when note codes NC of respective tone production channels are applied on the time division basis from the key assignor 21, the memory devices 30 and 31 output, on the time division basis, data representing the frequency division ratio N assigned to the tone production channels ch1 through ch12 and the data representing the number of the frequency division operations of N+1, in synchronism with respective channel timings.

tion channel chi, a frequency division data regarding thereto is latched in the latch circuit 28 in accordance with the channel timing signal t·chi. The channel timing signals t·ch1 through t·ch12 are formed in the following manner. More particularly, as above described, since the synchronizing signal SYNC outputted from the key assignor 21 is generated in synchronism with the channel timing of the first tone production channel ch1, this synchronizing signal SYNC is used as it is as the timing signal t·ch1 showing the channel timing of the first tone production channel ch1. The synchronizing signal SYNC is supplied to a shift register 220 having 11 stage memory positions, each including one bit so that when the synchronizing signal is given the shift register 220 sequentially shift it from the first stage to the 11th stage accordig to the clock pulse $\phi$. The output signals from respective stages of the shift register 220 correspond to signals obtained by sequentially delaying by one channel timings the synchronizing signal SYNC, so that the output signal from the first stage of the shift register 220 acts as a timing signal t·ch2 representing the channel timing of the second tone production channel ch2. In the same manner, the output signal from the second to 11th stages act as the timing signals t·ch3 through t·ch12 representing the channel timings of the third to 12th tone production channels ch3 through ch12.

In each of the tone production channels ch1 through ch12, the frequency division ratio latched in the latch circuit 28 is applied to one input of a comparator 11. Consequently, as has been described in connection with the basic circuit shown in FIG. 1, when a frequency division ratio control signal "1" designating a frequency division operation at a ratio of N+1 is latched in the latch circuit 4, the comparator 11 would produce a coincidence signal EQ having a frequency of (fo)×1/(N+1)) which is 1/(N+1) times of the frequency fo of the clock pulse $\phi$. On the other hand, when a frequency division ratio control signal "0" is latched in the latch circuit 4, the comparator 11 would produce a coincidence signal EQ having a frequency of (fo)×1/(N) which is sent out through AND gate circuit 3 in synchronism with the channel timing of a given

TABLE II

| note name | frequency division ratio N | number of frequency divisions N + 1 | total frequency division ratio | contents of frequency division ratio number of frequency division operations 0 | 1 | 2 | 3 | 4 | 5 | 5 | 7 | 8 | 9 | 10 | 11 | 12 | 13 | 14 | 15 |
|---|---|---|---|---|---|---|---|---|---|---|---|---|---|---|---|---|---|---|---|
| C# | 28 | 3 | 451 | 28 | 28 | 28 | 28 | 29 | 28 | 28 | 28 | 29 | 28 | 28 | 28 | 29 | 28 | 28 | 28 |
| D | 26 | 10 | 426 | 26 | 27 | 26 | 27 | 27 | 27 | 26 | 27 | 26 | 27 | 26 | 27 | 27 | 27 | 26 | 27 |
| D# | 25 | 2 | 402 | 25 | 25 | 25 | 25 | 26 | 25 | 25 | 25 | 25 | 25 | 25 | 25 | 26 | 25 | 25 | 25 |
| E | 23 | 11 | 379 | 23 | 24 | 23 | 24 | 24 | 24 | 23 | 24 | 24 | 24 | 23 | 24 | 24 | 24 | 23 | 24 |
| F | 22 | 6 | 358 | 22 | 22 | 23 | 22 | 23 | 22 | 23 | 22 | 22 | 22 | 23 | 22 | 23 | 22 | 23 | 22 |
| F# | 21 | 2 | 338 | 21 | 21 | 21 | 21 | 22 | 21 | 21 | 21 | 21 | 21 | 21 | 21 | 22 | 21 | 21 | 21 |
| G | 19 | 15 | 319 | 19 | 20 | 20 | 20 | 20 | 20 | 20 | 20 | 20 | 20 | 20 | 20 | 20 | 20 | 20 | 20 |
| G# | 18 | 13 | 301 | 18 | 19 | 19 | 19 | 18 | 19 | 19 | 19 | 19 | 19 | 19 | 19 | 18 | 19 | 19 | 19 |
| A | 17 | 12 | 284 | 17 | 18 | 18 | 18 | 17 | 18 | 18 | 18 | 17 | 18 | 18 | 18 | 17 | 18 | 18 | 18 |
| A# | 16 | 12 | 268 | 16 | 17 | 17 | 17 | 16 | 17 | 17 | 17 | 16 | 17 | 17 | 17 | 16 | 17 | 17 | 17 |
| B | 15 | 13 | 253 | 15 | 16 | 16 | 16 | 15 | 16 | 16 | 16 | 16 | 16 | 16 | 16 | 15 | 16 | 16 | 16 |
| C | 14 | 15 | 239 | 14 | 15 | 15 | 15 | 15 | 15 | 15 | 15 | 15 | 15 | 15 | 15 | 15 | 15 | 15 | 15 |

The data representing the frequency division ratio N read out from the memory device 30 are commonly supplied to the tone production channels ch1 through ch12 via a bus line 40. In each one of the tone production channels ch1 through ch12, the frequency division data regarding a specific channel among the frequency division data sent through the bus line 40 is latched by a latch circuit 28 in accordance with a channel timing signal (one of t·ch1 through t·Ch12) corresponding to that specific channel. For example, in the tone producchannel to act as a frequency signal corresponding to the note name of a key assigned to that channel (one of ch1 through ch12).

In this manner, the note name frequency signal outputted from the AND gate circuit 13 of each of the tone production channels ch1 through ch12 is applied to adder 50B of a time division counter 5B. The number of the note name frequency signals of a given tone production channel is counted by the time division counter 5B in synchronism with the channel timing thereof as a signal representing the number of frequency division operations performed by the first counter of that channel at frequency division ratios N and N+1, and the value thus counted is outputted as the number of frequency division operations.

In this example, the first counter 1 of each one of the tone production channels ch1 through ch12 is constructed to complete one frequency division cycle by executing 16 times the frequency division operations at a ratio of N or N+1 as shown in Table II, but the adder 50B and the shift register 51B of the time division counter 5B are constructed to be able to count more than 16 frequency division operations. Because, in this example, the time division counter 5B is constructed to also effect the octave division operation for forming the note name frequency signal of each octave by sequentially reducing to ½ the note name frequency signal. As above described, by determining the number of frequency division operations of one frequency division cycle to be 16, a signal of a frequency corresponding to the overall frequency division ratio shown in Table II can be produced as a signal B3 at the fourth bit from the least significant bit of the time division counter 5B. Taking this signal B3 as the note name frequency signal in the highest octave tone range, signals B4, B5, B6, B7 and B8 at higher orders than B3 represent the note name frequency signals in octave tone ranges respectively 1, 2, 3, 4 and 5 octaves lower than the highest octave tone range and their frequencies are shown in the following Table III.

TABLE III

| signal | B8 | B7 | B6 | B5 | B4 | B3 |
|---|---|---|---|---|---|---|
| frequency | (fn) × 1/32 | (fn) × 1/16 | (fn) × ⅛ | (fn) × ¼ | (fn)× ½ | fn |

Accordingly, when a predetermined bit signal among these upper 6 bit signals B8 through B3 is selected for each channel according to the octave of a key assigned to each of the tone production channels ch1 through ch12, a tone source frequency signal having a frequency corresponding to the tone pitch of that key can be obtained. Accordingly, the upper order 6 bit signals B8 through B3 of the count signals B8 through B0 outputted from the time division counter 5B and corresponding to respective tone production channels ch1 through ch12 are applied to a selector 33 which selects 3 bit signals out of signals B8 through B3 are selected for respective channels according to the octave codes OC of the tone production channels ch1 through ch12. The reason for selecting the 3 bit signals in the selector 33 is to simultaneously generate tone source frequency signals having frequencies corresponding to 4, 8 and 16 feets respectively.

The three types of the tone source frequency signals having frequencies corresponding to 4, 8 and 16 feets and selectively outputted for respective tone production channels ch1 through ch12 from the selector 33 are added with a key-on signal and then commonly applied to respective tone production channels ch1 through ch12. However, since the tone source signals and the key-on signals KON regarding these tone production channels are synchronous with the channel timings corresponding to these tone production channels, in these channels, the tone source frequency signals and key-on signals KON relating thereto are latched in respective latch circuits 25 according to their channel timing signals t·ch1 through t·ch12.

For example, in the tone production channel chi, a tone source frequency signal and a key-on signal KON relating thereto are latched by the latch circuit 25 according to a channel timing signal t·chi.

In each of the tone production channels, the tone source frequency signal latched by the latch circuit 25 is supplied to a latch circuit 26, while the key-on signal KON is applied to a envelope imparting circuit 27 as a control signal.

The purpose of the latch circuit 26 is to remove the clock components considered to be contained in the tone source frequency signal latched by the latch circuit 25 and to sample and hold the tone source frequency signal from the latch circuit 25 according to the note name frequency signal (coincidence signal EQ) outputted from the comparator 11 of the first counter 1. More particularly, the latch circuit 26 samples and holds the tone source frequency signal from the latch circuit 25 according to a note name frequency signal (EQ) having a frequency of an integer multiple ($2^n$ times) of the frequency of the tone source frequency signal to produce a tone source frequency signal removed with clock component and an unwanted reflected noise. The tone source frequency signal produced by the latch circuit 26 is applied to the envelope imparting circuit 27 to be imparted with an envelope shape in response to the key-on signal KON and outputted in parallel as a tone source signal (musical tone signal) of 4, 8 and 16 feets respectively.

Among the count signals B8 through B0 outputted from the time division counter 5B on the time division basis and regarding respective tone production channels ch1 through ch12, the lower order 4 bit signals B3 through B0 are supplied to a frequency division ratio control circuit 32 to act as counted values representing the number of the frequency division operations in one frequency division cycles of the first counter 1 of each of the tone production channels ch1 through ch12. The requency division ratio control circuit 32 corresponds to the frequency division ratio control circuit 8 shown in FIG. 1 and is constructed to produce, on the time division basis, frequency division control signals representing frequency division timings for dividing frequency at a ratio of N+1 among 16 frequency division timing in one frequency division cycle for discrete tone production channels ch1 through ch12. In this case the number of the frequency division operations made at a frequency division ratio of N+1 during one frequency division cycle is different for respective note names as shown in Table II. Considering a case of generating a note name frequency signal corresponding to a note name C♯, as a principle this signal can be obtained by decreasing the frequency of the clock pulse $\phi$ to 1/451 so that in one frequency division cycle, the frequency division operations are performed consecutively for three times at a ratio of N+1=29 and then the frequency division operations at a ratio of N=28 are continuously performed 13 times. With this measure, however, a great number of frequency division steps is necessary until note name frequency signals of a duty factor of 50% are obtained by decreasing the note name frequency signals to ½, because the periods of the note name frequency signals at the initial portion and the remaining portion of one frequency division cycle are not equal.

Accordingly, for the purpose of producing note name frequency signals at respective octaves at a duty factor of 50%, the frequency division timings at a lower ratio of frequency division are uniformly distributed in the frequency division timings at a larger frequency division ratio in one frequency division cycle. Table II was prepared based on this concept, and the frequency ratio control circuit 32 designates the frequency division timings at a frequency division ratio of N+1 according to Table II. For this reason, the frequency ratio control circuit 32 is constructed to produce the frequency division timings of N+1 for respective note names in one frequency division cycle according to Table II. More particularly, the frequency division ratio control circuit 32 is constituted by a converter 320 which converts the number of frequency division operations B3 through B0 outputted from the time division counter 5B into 4 bit signals S2, S2, S1 and S0 shown in the following Table IV according to the number of the frequency division operations at a ratio of N+1 in one frequency division cycle, AND gate circuits 321 through 324 which determine logical products of signals S3 though S0, and 4 bit signals x3 through x0 representing the number of frequency division operations at a ratio of N+1 in each frequency division cycle outputted from the memory device 31, and an OR gate circuit 325 which produces a logical sum signal of the output signals of the AND gate circuits 321 through 324 as a frequency division ratio control signal Co.

The converter 320 is constituted by NOR gate circuits 3200 through 3202 and AND gate circuits 3203 through 3205.

TABLE IV

| input | | | | output | | | |
|---|---|---|---|---|---|---|---|
| B3 | B2 | B1 | B0 | S3 | S2 | S1 | S0 |
| 0 | 0 | 0 | 0 | 0 | 0 | 0 | 0 |
| 0 | 0 | 0 | 1 | 1 | 0 | 0 | 0 |
| 0 | 0 | 1 | 0 | 0 | 1 | 0 | 0 |
| 0 | 0 | 1 | 1 | 1 | 0 | 0 | 0 |
| 0 | 1 | 0 | 0 | 0 | 0 | 1 | 0 |
| 0 | 1 | 0 | 1 | 1 | 0 | 0 | 0 |
| 0 | 1 | 1 | 0 | 0 | 1 | 0 | 0 |
| 0 | 1 | 1 | 1 | 1 | 0 | 0 | 0 |
| 1 | 0 | 0 | 0 | 0 | 0 | 0 | 1 |
| 1 | 0 | 0 | 1 | 1 | 0 | 0 | 0 |
| 1 | 0 | 1 | 0 | 0 | 1 | 0 | 0 |
| 1 | 0 | 1 | 1 | 1 | 0 | 0 | 0 |
| 1 | 1 | 0 | 0 | 0 | 0 | 1 | 0 |
| 1 | 1 | 0 | 1 | 1 | 0 | 0 | 0 |
| 1 | 1 | 1 | 0 | 0 | 1 | 0 | 0 |
| 1 | 1 | 1 | 1 | 1 | 0 | 0 | 0 |

For example, suppose now that a note name frequency signal to be generated by the first counter 1 of the tone production channel chi relates to a note name C# (that is the key of the note name C# is assigned to the tone production channel chi). Then, the memory device 31 produces signals x3, x2, x1 and x0="1100" representing the number 3 (see Table II) of frequency division operations to be performed at a frequency division ratio of N+1 in one frequency division cycle in synchronism with the channel timing corresponding to the tone production channel chi. On the other hand, the time division counter 5B produces count signals B3 through B0 representing the number of the frequency division operations up to the present time in one frequency division cycle of the first counter 1 of the channel chi (the number of frequency division operations at the frequency division ratios of N=28 and N+1=29) and these count signals B3 through B0 are applied to the converter 320. Where the number of frequency division operations lises in the ranges of 0 through 3, 5 through 7, 9 through 11 and 13 through 15, signals S1 and S0 among the output signals S3 through S0 from the converter 320 are both "0" (see Table IV). At this time, to one inputs of the AND gate circuits 321 through 324 are respectively applied x3="0", x2="0", x1="0" and x0="1" from the memory device 31 as above described. Under this condition, the AND gate circuits 321 through 324 are disabled so that the frequency division ratio control signal Co would not be produced.

When the counts of the number of frequency division operations are 4, 8 and 12, either one of the signals S1 and S0 of the output signals S3 through S0 of the converter 320 becomes "1" (see Table IV). Consequently, the AND gate circuits 323 and 324 are enabled when the counts are 4, 12 and 8, so that the OR gate circuit 325 produces a frequency division ratio control signal C0 of "1" in synchronism with a channel timing corresponding to the tone production channel chi which form a note name frequency signal regarding the note name C#. The pulse width of the control signal C0 is equal to one period of the clock pulse $\phi$.

Where the note name frequency signal to be generated by the first counter 1 of the tone production channel chi is related to the note name C (that is when a key of the note name C is assigned to the tone production channel chi), the memory device 31 produces signals x3, x2, x1 and x0 "1111" representing the number 15 of the frequency division operations to be performed at a ratio of N+1 in one frequency division cycle (see Table II) in synchronism with the channel timing corresponding to the tone production channel chi. At the channel timing corresponding to the tone production channel chi, the time division counter 5B produces count signals B3 through B0 representing the number of the frequency division operations up to the present in one frequency division cycle of the first counter 1 of the channel chi (that is the number of the frequency division operations at ratios of N=14 and N+1=15) and these count signals are applied to the converter 320. When the count of the frequency division operations is in a range of from 1 to 15, either one of the output signals S3 through S0 of the converter 320 becomes "1" whereas when the count of the number of the frequency division operations is zero none of the signals S3 through S0 becomes "1". At this time, one inputs of the AND gate circuits 321 through 324 are supplied with signals x3="1", x2="1", x1="1" and x0="1" respectively from the memory circuit 31. For this reason, when the counts are in a range of from 1 to 15, either one of the AND gate circuits 321 through 324 is enabled to produce a frequency division ratio control signal of "1" from the OR gate circuit 325. But when the count is zero, no frequency division ratio control signal C0 is produced. As a consequence, in this case, a frequency division operation at a ratio of N+1=15 is performed 15 times in one frequency division cycle.

As above described the frequency division ratio control signals C0 outputted from the frequency division ratio control circuit 32 on the time division basis and regarding respective tone production channels ch1 through ch12 are commonly supplied to all tone production channels ch1 through ch12. In each of these channels, a frequency division ratio control signal C0 regarding thereto is latched by the latch circuit 4 to set the frequency division ratio of the first counter 1 to N or N+1.

As above described according to this embodiment, for the purpose of forming predetermined note name frequency signals by dividing the frequency of a clock pulse $\phi$ according to a combination of frequency division ratios of N and N+1, since the transfer of the frequency division ratio between N and N+1 in respective tone production channels is controlled by a single time division counter, it is possible to simplify the entire construction.

Especially, as the time division counter is designed to be able to count the number of the frequency division operations more than a predetermined frequency division ratio determined by a combination of the ratio N and N+1, it is possible to cause the time division counter to also act as an octave frequency divider. Moreover, since the tone source frequency signals formed on the time division basis according to the counts of the time division counter and concerning respective tone production channels are sampled and held at frequencies of integer multiples of those of respective tone source frequency signals, converted into continuous signals for respective tone production channels and then outputted as the tone source signals, it is possible to obtain tone source signals removed with clock components or unwanted reflected noise components, thus eliminating distortion of the musical tone waveform as well as not clear musical tone.

Although in this embodiment, the time division counter is constructed to also act as an octave frequency divider, an independent octave frequency divider may be provided as in the prior art circuit. Furthermore, while the frequency of a note name frequency signal (coincidence signal EQ) is suitably divided to produce a tone source signal (musical tone signal) it is possible to use the note name frequency signal for producing an address signal for a waveform memory device.

Figure 6:
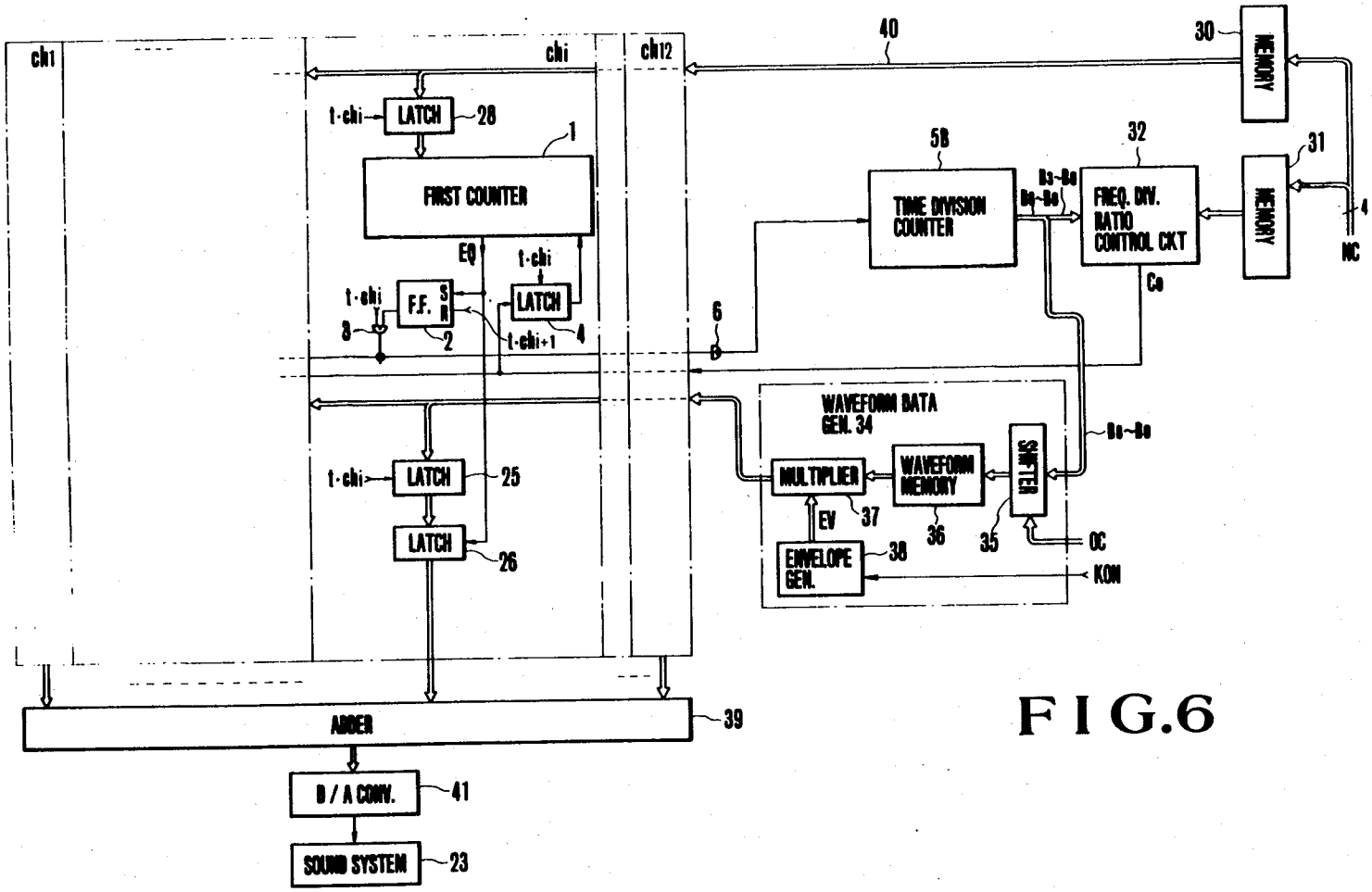
FIGS. 6 and 7 are block diagrams showing the detail of the other examples of the tone generator shown in FIG. 4.

FIG. 6 shows a modification of the tone generator 22 shown in FIG. 4. In this modification, a waveform memory device for storing a desired musical tone waveform is used and it is constructed to produce musical tone signals corresponding to keys assigned to respective tone production channels ch1 through ch12 by reading out the waveform memory device by utilizing the count output signals B8 through B0 of the time division counter 5B shown in FIG. 5. In FIG. 6, elements corresponding to those shown in FIG. 5 are designated by the same reference numerals.

As shown in FIG. 6, a waveform data generator 34 is provided between the time division counter 5B and the respective tone production channels ch1 through ch12. The time division counter 5B produces, on the time division basis, count signals B8 through B0 obtained by counting the number of note name frequency signals having frequencies corresponding to the note names of the keys assigned to respective tone production channels ch1 through ch12 as above described, in synchronism with respective channel timings. These count signals are applied to a shifter 35 of the waveform generater 34.

The shifter 35 operates to shift toward upper order bit side or lower order bit side the count signals B8 through B0 regarding respective tone production channels ch1 through ch12 and outputted from the time division counter 5B on the time division basis according to the octave codes OC of respective tone production channels ch1 through ch12 and to apply the shifted count signals to a waveform memory device 36 to act as address signals. Thus, the function of the shifter 35 is similar to that of the selector 3 shown in FIG. 5.

The waveform memory device 36 is constituted by a read only memory device or the like that stores amplitude values at various sampling point of a musical tone waveform corresponding to a desired tone color. Upon receipt of an address signal from the shifter 35, the prestored amplitude values at respective sampling points of the musical tone waveform are sequentially read out as musical tone waveform data at a speed corresponding to the speed of variation of the address signal. More particularly, the musical tone waveform data having frequencies corresponding to the tone pitches of the depressed keys assigned to the tone production channels ch1 through ch12 are read out from the waveform memory device 36 on the time division basis and these musical tone waveform data are supplied to a multiplier 37, which sets the amplitudes of the musical tone waveform data read out from the waveform memory device 36 in accordance with a desired envelope waveform. The envelope waveform data for setting the amplitudes are supplied from an envelope generator 38. More particularly, when supplied with the key-on signals KON regarding respective tone production channels ch1 through ch12, the envelope generator 38 starts to operate in synchronism with the rise of the key-on signals KON to produce desired envelope waveform data EV for respective channels on the time division basis, and the data EV are applied to the multiplier 37. Then, in the multiplier 37, the musical tone waveform data read out from the waveform memory device 36 are multiplied with the envelope waveform data EV produced by the envelope generator 38, thus setting the amplitude envelope for the musical tone waveform data.

As above described, the multiplier 37 of the waveform data generator 34 produces, on the time division basis the musical tone waveform data set with the amplitudes of respective tone production channels ch1 through ch12 in synchronism with the respective channel timings and then suppies the musical tone waveform data to respective tone production channels ch1 through ch12. In the same manner as in FIG. 5, in each tone production channel, the musical tone waveform data relating thereto is latched by a latch circuit 25 of that channel. The musical tone waveform data stored in the latch circuit 25 is then latched by a latch circuit 26 according to the note name frequency signal (coincidence signal EQ) outputted from the first counter 1 to be converted into a continuous signal not containing a clock component and unwanted reflected noise components. As above described, the musical tone waveform data outputted from respective tone production channels ch1 through ch12 are synthesized in an adder 39 and then converted into an analog musical tone signal by a digital-analog converter 41 which is supplied to the sound system 23.

Thus, ths modification too can provide the same effect as the electronic musical instrument shown in FIG. 5.

Although in this modification, the output signals from the shifter 35 are used as the address signals for the waveform memory device 36, the output signals can be used as carrier wave signals or modulation signals in a method of synthesizing musical tone signal by utilizing a frequency modulation system.

Figure 7:
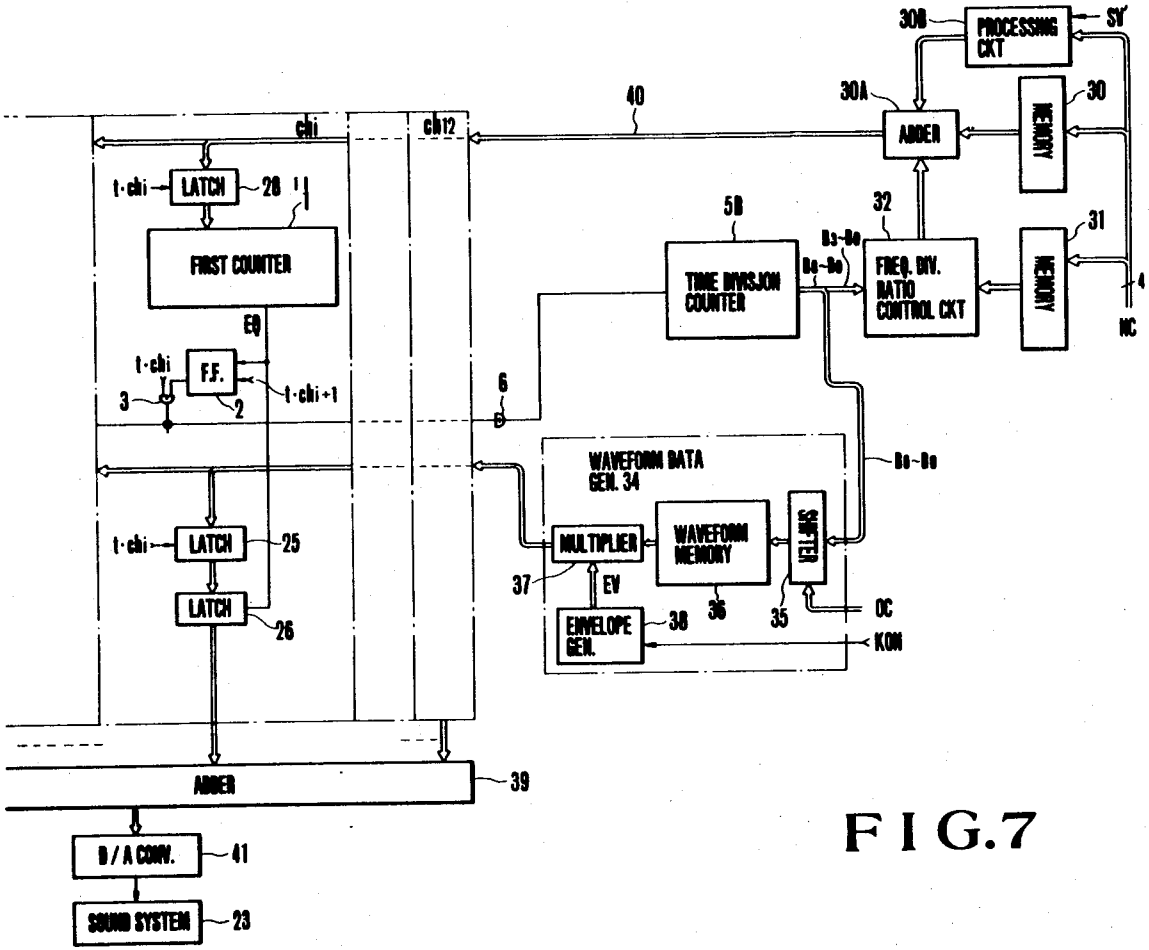

FIG. 7 shows a modification of FIG. 6. Although in FIG. 6, for the purpose of designating the number of the frequency division operations at the frequency division ratio of N+1, the frequency division ratio control signal C0 was supplied to the first counter 1 through the latch circuit 4, in this modification frequency division ratio control signal C0 is added to the frequency division data sent to a latch circuit 28 via a data bus line 40. More particularly, in this case, the frequention division ratio control signal C0 produced by the frequency division ratio control circuit 32 is applied to an adder 30A to add "+1" to the frequency division data N sent from the memory device 30.

In this case, it is also possible to superimpose a vibrato signal on the frequency division ratio data described above. In this case, a note code NC and a vibrato selection signal $S_V$ are applied to a vibrato selection circuit 30B which when supplied with the vibrato selection signal $S_V$, selects an address of a memory device contained therein in accordance with the note code NC, for applying a predetermined vibrato signal to the adder 30A. The construction of the remaining portions shown in FIG. 7 is identical to that shown in FIG. 6.

Figure 8:
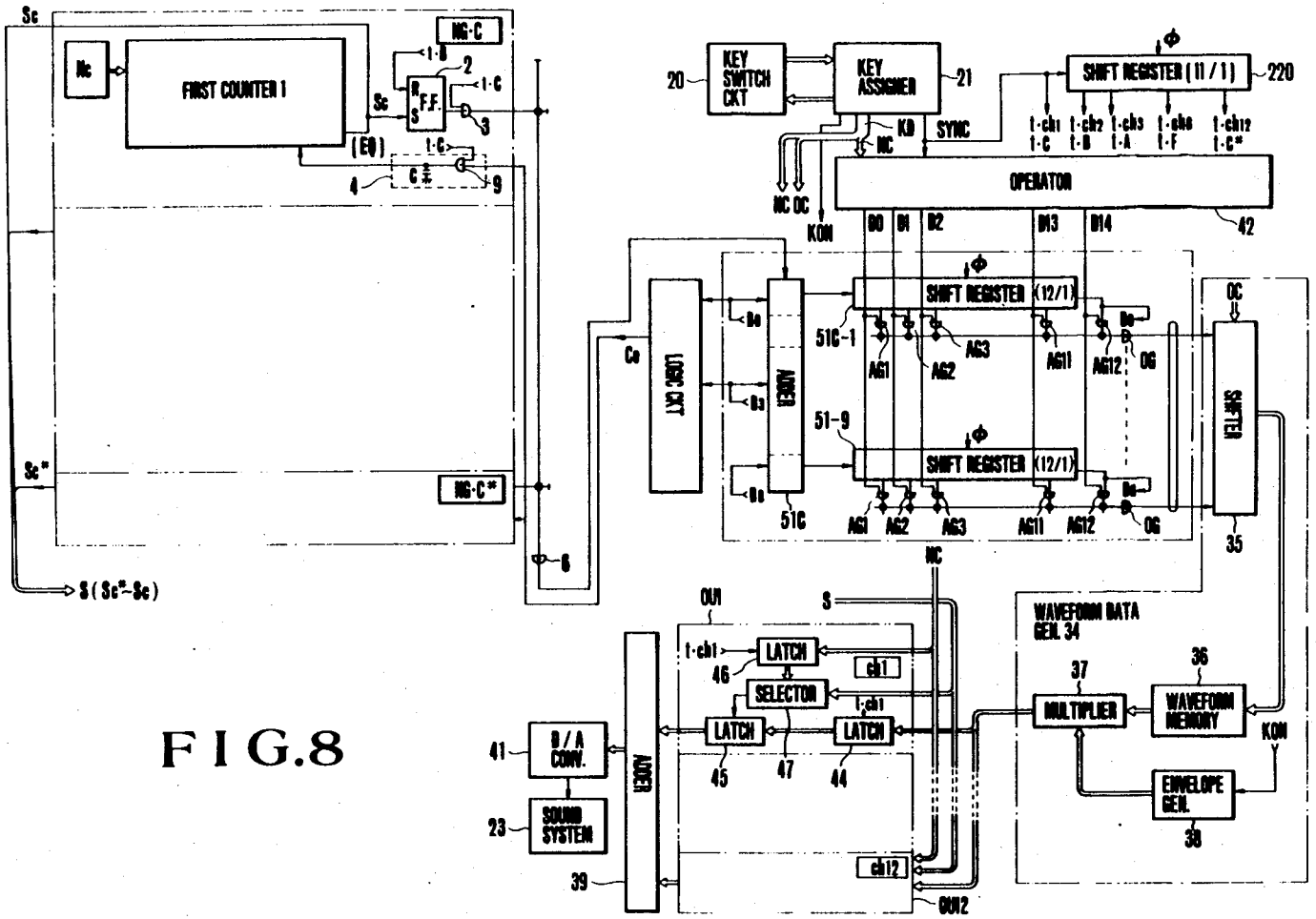
FIG. 8 is a block diagram showing another embodiment of the electronic musical instrument according to this invention.

FIG. 8 is a block diagram showing another embodiment of an electronic musical instrument in which the frequency division channels CH1 through CH12 shown in FIGS. 1, 2 and 3 are used as note signal generators of 12 note names C through C#. In this embodiment, note clock signals corresponding to 12 note names C#, D, D#, E, F, F#, G, G#, A, A#, B and C (inheretly they are arranged in the order of C, C#, . . . B, but altered for the convenience of description) and in each one of the tone production channels ch1 through ch12, a waveform memory device storing a musical tone waveform is read out according to a note clock signal corresponding to the note name of a key assigned to that channel thereby forming a musical tone signal corresponding to the key.

In FIG. 8, there are provided 12 note signal generators NG·C# through NG·C corresponding to respective note names C# through C for the purpose of generating the note clock signals. These note signal generators generate note clock signals SC# through SC having frequencies corresponding to predetermined note names C# through C.

In FIG. 8 only the generator NG·C regarding the note name C is shown in detail but it should be understood that other note signal generators NG·D through NG·B have the same construction. Each of the note signal generators NG·C# through NG·C has a construction similar to that of the frequency division channels CH1 through CH12 shown in FIG. 1, 2 or 3 and comprises a sample and hold circuit corresponding to the latch circuit 4 shown in FIGS. 1, 2 and 3 constituted by a first counter 1, a flip-flop circuit 2, AND gate circuits 3 and 9 and a capacitor C, so that the output signal EQ of the first counter 1 becomes the note clock signals SC# through SC described above. In this case, the data that determines the frequency division ratio N of the first counter 1 in each of the note signal generators NG·C# through NG·C is preset according to a predetermined note name (one of C# through C) for each generator.

The AND gate circuit 3 and the flip-flop circuit 2 adapted to take out the note clock signals SC# through SC outputted from the first counter 1 of respective generators NG·C# through NG·C are supplied with a note timing signal (one of t·C# through t·C) corresponding to the note timing and a note timing signal (one of t·C through t·B) corresponding to a succeeding note timing.

Respective note timings are shown in FIG. 9c, and note timing signals t·C, t·B, . . . t·C# are produced as shown in FIGS. 9(d) through 9(f) from the shift register 220. The shift register 220 has the same construction as the shift register 220 shown in FIG. 5, thus generating channel timing signals t·ch1 through t·ch12. The channel timing signal t·ch1 is produced directly by the synchronizing signal SYNC. As shown in FIGS. 9(c) and 9(g), the note timings of respective note names C# through C corresponds to the channel timings of respective tone production channels ch1 through ch12, whereas the note timings of note names C, B, A#, A, G#, GF#, F, E, D#, D and D# respectively correspond to the channel timings of the first to 12th tone production channels ch1 through ch12. Conssequently, it is possible to use channel timing signals t·ch1, t·ch2, t·ch3 . . . t·ch12 as the note timing signals t·C, t·B, t·A# . . . t·C#.

The note clock signals SC# through SC generated from the first counter 1 of each one of the note signal generators NG·C# through NG·C are parallelly supplied to the output ciruits OU1 through OU12 of respective tone production channels ch1 through ch12 and at the same time time-divisioned in synchronism with the note timings of respective note names C# through C and then suppied to a time division counter 5C via an OR gate circuit 6.

The time division counter 5C operates in the same manner as the time division counter 5 shown in FIG. 1 and the time division counter 5B shown in FIG. 5, and by counting, on the time division basis, respective note clock signals SC# through SC with reference to respective note names, counts on the time division basis, the number of frequency division operations of respective generators at frequency division ratios of N and N+1 of the first counters 1 of the note signal generators NG·C# through NG·C. In this modification, as the counts of the time division counter 5C are expressed by signals B8 through B0 of the 9 bit construction, there are provided a 9 bit adder 51C and a 9 shift registers 51C-1 through 51C-9 having 12 stage memory positions corresponding to respective note names C# through C. The 9 bit count signals B8 through B0 outputted from the 12th or last stages of the shift registers 51C-1 through 51C-9 are fed back to the adder 50C to be added to the note clock signal S (one of SC through SB) of a corresponding note name. The results of addition are set in the first stages of the shift registers 51C-1 through 51C-9 in bit units and the set data are sequentially shifted toward the 12th stages each time a clock pulse $\phi$ is generated. Thus, the time division counter of this embodiment has a construction such that the time division counter 5B shown in FIG. 5 is divided with bit units.

The lower 4 bit signals B3 through B0 among the count signals B8 through B0 outputted from the 12th stages of respective shift registers 51C-1 through 51C-9 of the time division counter 5C are supplied to a logic circuit 43 which is provided for the purpose of producing a frequency division control signal C0 that designates that whether the first counter 1 of each one of the note signal generating circuit NG·C# through NG·C should perform a frequency division operation at a frequency division ratio of N or N+1 in accordance with the count signals B3 through B0 for respective note names (see Table II). Although not shown in detail, it has a construction equivalent to a combination of the frequency division ratio control circuit 32 and the memory device 31 shown in FIG. 5. However, in the case shown in FIG. 5, the note names of the note name frequency signals (note clock signals) formed in respective tone production channels ch1 through ch12 are not fixed but vary corresponding to the note names of the assigned keys so that it is necessary to provide a memory device 31 addressed by the note code NC. In the embodiment shown in FIG. 8, however, since the note names of the note clock signals S produced in respective note signal generators NG·C# through NG·C are predetermined for these note signal generators, the frequency division ratio control signal C0 may be produced based upon only the count signals B3 through B0 outputted from the time division counter 5C. Accordingly, when the count signals B3 through B0 for respective note names produced by the time division counter 5C are supplied in synchronism with respective note timings, the logic circuit 43 produces the frequency division ratio control signals C0 having a predetermined content ("0" or "1") determined by the number of frequency division operations represented by the signals B3 through B0, in synchronism with respective note timings.

The frequency division ratio control signal C0 is commonly supplied to respective note signal generators NG·C# through NG·C. Then, each of the signal generator selects a frequency division ratio control signal C0 according to one of the note timing signals t·C# through t·C corresponding to each signal generator by AND gate circuit 9 and the selected frequency division ratio control signal is held by capacitor C, whereby the frequency division ratio of the first counter 1 is controlled to be N or N+1.

The time division counter 5C is constituted by 12 AND gate circuits AG1 through AG12 respectively provided for the shift registers 51C-1 through 51C-9 and inputted with output signals from respective stages and 12 note selection signals D0 through D14 (excluding D3, D7 and D1) outputted from an operator 42 and an OR gate circuits OG respectively supplied with the output signals of the AND gate circuits AG1 through AG12. These AND gate circuits AG1 through AG12 and the OR gate circuits OG respectively select, for respective channels, count signals B8 through B0 corresponding to the note names of the keys assigned to respective tone production channels out of the count signals B8 through B0 of respective note names of respective stages of the shift registers 51C-1 through 51C-9, and supply the selected count signals to the waveform data generator 34.

Whether the count signals B8 through B0 regarding respective note names C# through C present at which stages of the shift registers 51C-1 through 51C-9 is determined by judging the note timing at that time. For example, at a note timing regarding the note name C at which the note timing signal t C is generated, the count signals B8 through B0 regarding respective note names C#, D, D#, . . . C present at the first stage, second stage, third stage . . . 12th stage (the last stage) respectively. This is shown by the following Table V in which digits 1, 2, 3 . . . 12 show the stage numbers of the shift registers 51C-1 through 51C-9.

TABLE V

| note timing | note names of count signals B8–B0 | | | | | | | | | | | |
|---|---|---|---|---|---|---|---|---|---|---|---|---|
| | C# | D | D# | E | F | F# | G | G# | A | A# | B | C |
| C | 1 | 2 | 3 | 4 | 5 | 6 | 7 | 8 | 9 | 10 | 11 | 12 |

TABLE V-continued

| note timing | note names of count signals B8–B0 | | | | | | | | | | | |
|---|---|---|---|---|---|---|---|---|---|---|---|---|
| | C# | D | D# | E | F | F# | G | G# | A | A# | B | C |
| B | 2 | 3 | 4 | 5 | 6 | 7 | 8 | 9 | 10 | 11 | 12 | 1 |
| A# | 3 | 4 | 5 | 6 | 7 | 8 | 9 | 10 | 11 | 12 | 1 | 2 |
| A | 4 | 5 | 6 | 7 | 8 | 9 | 10 | 11 | 12 | 1 | 2 | 3 |
| G# | 5 | 6 | 7 | 8 | 9 | 10 | 11 | 12 | 1 | 2 | 3 | 4 |
| G | 6 | 7 | 8 | 9 | 10 | 11 | 12 | 1 | 2 | 3 | 4 | 5 |
| F# | 7 | 8 | 9 | 10 | 11 | 12 | 1 | 2 | 3 | 4 | 5 | 6 |
| F | 8 | 9 | 10 | 11 | 12 | 1 | 2 | 3 | 4 | 5 | 6 | 7 |
| E | 9 | 10 | 11 | 12 | 1 | 2 | 3 | 4 | 5 | 6 | 7 | 8 |
| D# | 10 | 11 | 12 | 1 | 2 | 3 | 4 | 5 | 6 | 7 | 8 | 9 |
| D | 11 | 12 | 1 | 2 | 3 | 4 | 5 | 6 | 7 | 8 | 9 | 10 |
| C# | 12 | 1 | 2 | 3 | 4 | 5 | 6 | 7 | 8 | 9 | 10 | 11 |

Figure 9:
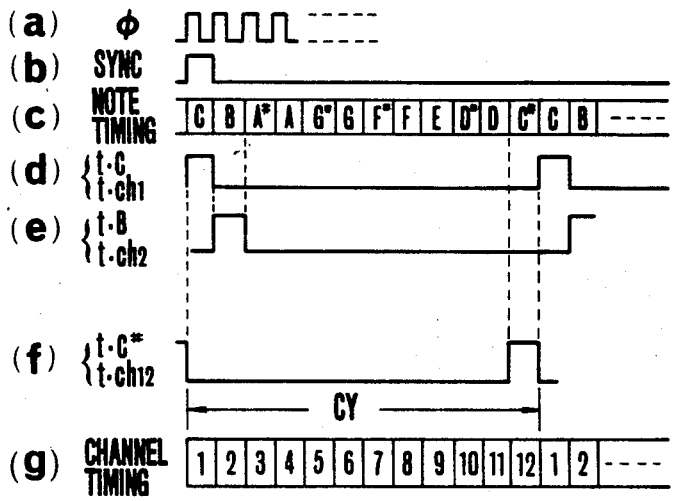
FIG. 9 is a timing chart useful to explain the operation of the embodiment shown in FIG. 8.

The relations between the note timings of respective note names C# through C and the channel timings of the tone production channels ch1 through ch12 are shown in FIGS. 9(*c*) and 9(*g*), with FIG. 9(*a*) indicating system clock pulses o and FIG. 9(*b*) indicating SYNC pulses which are generated after 12 system clock pulses, each SYNC pulse specifying 1 in the channel timing.

Accordingly, by generating a predetermined one of the note selection signals D0 through D14 from each one of the note production channels ch1 through ch12 in accordance with the note name of a key assigned to each channel and with the note timing of that channel, it is possible to sequentially select the counts B8 through B0 corresponding to the note names of the keys assigned to respective tone production channels at respective channel timings. For example, suppose now that a key of the note name B is assigned to the first tone production channel ch1. Then the channel timing of the first tone production channel ch1 is the note timning of the note name C (see FIG. 7) and at the note timing of the note name C, as the count signals B8 through B0 regarding the note name B present at the 11th stages of the shift registers 51C-1 through 51C-7 (see Table V), the operator 42 would produce a note selection signal D13 of "1". Consequently AND gate circuits AG11 are enabled to derive out the count signals B8 through B0 regarding the note name B and presenting at the 11th stages of the shift registers 51C-1 through 51C-9 and the derived out count signals are supplied to the waveform data generator 34 via OR gate circuits OG.

In this manner, the time division counter 5C produces, on the time division basis, the count signals B8 through B0 regarding the note names of the keys assigned to respective tone production channels ch1 through ch12 in synchronism with respective channel timings, and the produced count signals are supplied to the waveform data generator 34.

The waveform data generator 34 has the same construction as the waveform data generator 34 shown in FIG. 6, is constituted by a shifter 35, a waveform memory device 36, a mutiplier 37 and an envelope generator 38 and produces, on the time division basis, musical tone waveform data imparted with a predetermined amplitude envelope and having frequencies corresponding to the tone pitches of the keys assigned to respective tone production channels ch1 through ch12 in synchronism with respective channel timings. The musical tone waveform data for respective tone production channels ch1 through ch12 produced by the waveform data generator 34 are commonly supplied to the output circuits OU1 through OU12 of the tone production channels ch1 through ch12.

The output circuits OU1 through OU12 correspond to the latch circuits 25 and 26 provided for respective tone production channels ch1 through ch12 and convert the musical tone waveform data of respective tone production channels outputted from the waveform generator on the time division basis into the musical tone waveform data in the form of a continuous signal not containing any clock components and unwanted reflected noise components in respective channels.

Each one of the output circuits OU1 through OU12 includes latch circuits 44 and 45 corresponding to the latch circuits 25 and 26 shown in FIG. 6 and storing the musical tone waveform data regarding to respective tone production channels according to the channel timing signals t·ch1 through t·ch12. Furthermore, the output circuits OU1 through OU12 include latch circuits 46 and selectors 47 for selecting note clock signals S corresponding to the note times of the keys assigned to respective channels out of the note clock signals SC# through Sc. Each latch circuit 46 stores a note NC relating to a specific channel regarding one of the tone production channels ch1 through ch12 according to one of the channel timing signals t·ch1 through t·ch12. Each selector 47 selects one of the 12 note clock signals SC# through SC regarding a specific channel according to the note channel stored in the latch circuit 46 and applies the selected note clock signal S (one of SC# through SC) to act as a latch timing signal. To the latch circuit 45 is applied the musical tone waveform data from the latch circuit 44 as the data to be latched therein. Accordingly, the musical tone waveform data outputted from the latch circuit 44 are sampled and held by the note clock signal S having a frequency of an integer multiple ($2^n$) of the frequency of a musical tone signal to be produced in the specific tone production channel, whereby the musical tone waveform data are converted into a continuous signal not containing any clock components and unwanted reflected noise components described above.

The musical tone waveform data outputted from the output circuits OU1 through OU12 of respective tone production channels ch1 through ch12 are synthesized in the adder 39 and, then converted into an analog musical tone signal by the digital-analog converter 41, and supplied to the sound system 23.

The detail of the operator 42 which generates the note selection signals D0 through D14 described above will be described in detail with reference to FIG. 10.

Figure 10:
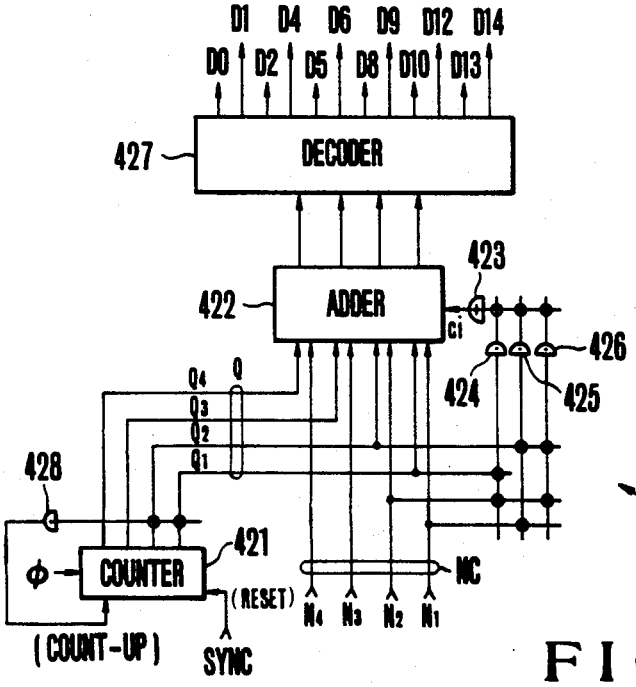
FIG. 10 is a block diagram showing the detail of the construction of the operator shown in FIG. 8

As shown in FIG. 10 a counter 421 has a 4 bit construction for counting the number of clock pulses and among its count output signals Q4 through Q1, the logical product of signals Q2 ($2^1$) and Q1 ($2^0$) are applied to the count up input terminal of the counter 421 via an AND gate circuit 428. Accordingly, as shown in the following Table VI the counter 421 performs a modified 12 stage counting operation up to Q=0 to 12 in which counts Q=3, 7, 11 and 15 (decimal representation) do not present. The counter 421 is reset by a synchronizing signal SYNC (generated at the time of generation of the note timing of the note name C). Consequently, the counts Q=0, 1, 2, 4, 5, 6, 8, 9, 10, 12, 13 and 14 of the counter 421 respectively represent the note timings of the note names C, B, A#, A, G#, G, F#, F, E, D#, D and C#.

TABLE VI

| Count Q | | | | | |
|---|---|---|---|---|---|
| Q4 ($2^3$) | Q3 ($2^2$) | Q2 ($2^1$) | Q1($2^0$) | decimal representation | note timing |
| 0 | 0 | 0 | 0 | 0 | C |
| 0 | 0 | 0 | 1 | 1 | B |
| 0 | 0 | 1 | 0 | 2 | A# |
| 0 | 1 | 0 | 0 | 4 | A |
| 0 | 1 | 0 | 1 | 5 | G# |
| 0 | 1 | 1 | 0 | 6 | G |
| 1 | 0 | 0 | 0 | 8 | F# |
| 1 | 0 | 0 | 1 | 9 | F |
| 1 | 0 | 1 | 0 | 10 | E |
| 1 | 1 | 0 | 0 | 12 | D# |
| 1 | 1 | 0 | 1 | 13 | D |
| 1 | 1 | 1 | 0 | 14 | C# |

The reason that the counter 421 performs the modified 12 stage counting operation is to cause the relations between the counts Q of the counter 21 and the respective note timings to be correlated with the states of assignment of respective note names C# through C for respective contents of the note codes NC (4 bit construction) so as to simplify the constructions of the note selection signals D0 through D14. The note codes NC (N4 through N1) each having a 4 bit construction are represented by modified decimal representations of from 0 through 14 except decimal representations 3, 7 and 11 as shown in the following Table VII, and note names C# through C are respectively assigned to these numerical data 0 through 14.

TABLE VII

| note code NC | | | | | note |
|---|---|---|---|---|---|
| N4 | N3 | N2 | N1 | decimal representation | name |
| 0 | 0 | 0 | 0 | 0 | C# |
| 0 | 0 | | 1 | 1 | D |
| 0 | 0 | 1 | 0 | 2 | D# |
| 0 | 1 | 0 | 0 | 4 | E |
| 0 | 1 | 0 | 1 | 5 | F |
| 0 | 1 | 1 | 0 | 6 | F# |
| 1 | 0 | 0 | 0 | 8 | G |
| 1 | 0 | 0 | 1 | 9 | G# |
| 1 | 0 | 1 | 0 | 10 | A |
| 1 | 1 | 0 | 0 | 12 | A# |
| 1 | 1 | 0 | 1 | 13 | B |
| 1 | 1 | 1 | 0 | 14 | C |

As above described, by denoting the note timings of the note names C# through C by numerical data opposite to those of the note codes NC, the formation of the note selection signals D0 through D14, that is the detection regarding whether the count signals B8 through B0 relating to the note names represented by the note codes NC present or not at which stages of the shift registers 51C-1 through 51C-9 of the time division counter 5C, can be executed with an extremely simple addition operation.

Whether the counts signals B8 through B0 regarding respective note names C through B present or not at which stages of the shift registers 51C-1 through 51C-9 at respective timings (respective counts regarding the note names C through B) is best shown in Table V.

For the sake of description, in Table V, it is assumed now that the note timings are represented by the counts Q (see Table VI) of the counter 421, that the note names C# through C of the count signals B8 through B0 are represented by the numerical data (see Table VII) based on the note codes NC, and that the stage numbers of the shift registers 51C-1 through 51C-9 are represented by 0, 1, 2, 4, 5, 6, 8, 9, 10, 12, 13 and 14 not including 3, 7 and 11. Then the following Table VIII is obtained.

TABLE VIII

| *1 → | C# | D | D# | E | F | F# | G | G# | A | A# | B | C |
|---|---|---|---|---|---|---|---|---|---|---|---|---|
| *2 → | 0 | 1 | 2 | 4 | 5 | 6 | 8 | 9 | 10 | 12 | 13 | 14 |
| Q = 0 | 0 | 1 | 2 | 4 | 5 | 6 | 8 | 9 | 10 | 12 | 13 | 14 |
| 1 | 1 | 2 | 4 | 5 | 6 | 8 | 9 | 10 | 12 | 13 | 14 | 0 |
| 2 | 2 | 4 | 5 | 6 | 8 | 9 | 10 | 12 | 13 | 14 | 0 | 1 |
| 4 | 4 | 5 | 6 | 8 | 9 | 10 | 12 | 13 | 14 | 0 | 1 | 2 |
| 5 | 5 | 6 | 8 | 9 | 10 | 12 | 13 | 14 | 0 | 1 | 2 | 4 |
| 6 | 6 | 8 | 9 | 10 | 12 | 13 | 14 | 0 | 1 | 2 | 4 | 5 |
| 8 | 8 | 9 | 10 | 12 | 13 | 14 | 0 | 1 | 2 | 4 | 5 | 6 |
| 9 | 9 | 10 | 12 | 13 | 14 | 0 | 1 | 2 | 4 | 5 | 6 | 8 |
| 10 | 10 | 12 | 13 | 14 | 0 | 1 | 2 | 4 | 5 | 6 | 8 | 9 |
| 12 | 12 | 13 | 14 | 0 | 1 | 2 | 4 | 5 | 6 | 8 | 9 | 10 |
| 13 | 13 | 14 | 0 | 1 | 2 | 4 | 5 | 6 | 8 | 9 | 10 | 12 |
| 14 | 14 | 0 | 1 | 2 | 4 | 5 | 6 | 8 | 9 | 10 | 12 | 13 |

*1 note name of count signals B8 through B0
*2 note code NC (decimal representation)

For example, the count signals B8 through B0 regarding the note name C# are at the 0th stage when the count Q of the counter 421 is zero but as the count Q sequentially increases as 1, 2, . . ., the count signals shift toward the 14th stage.

In Table VIII, stage numbers other than those bounded by small circles coincide with the sum of the count Q of the counter 421 and the note code NC, while the stage numbers bounded by small circles coincide with the sum of the value of NC+Q and 1.

An analysis of the condition of executing an operation NC+Q+1 shows that $(N2=1)\cdot(Q1=1)+(N2=1)\cdot(Q2=1)+(N1=1)\cdot(Q2=1)$. Where N1 and N2 show the lower order bits of the note code NC as shown in Table VII, and Q1 and Q2 show the lower order bits of the count Q of the counter 421.

Accordingly, when the condition described above holds, a value obtained by adding "1" to the sum of the note code NC and the count Q shows the stage numbers of the shift registers 51C-1 through 51C-9 at which the count signals B8 through B0 corresponding the note names shown by the note codes NC present.

An adder 422, an OR gate circuit 423 connected to the carry input of the adder 422, and AND gate circuits 424, 425 and 426 are provided for executing the processing just described. More particularly, when the condition described above does not hold, the adder 422 outputs the sum NC+Q of the count Q of the counter 421 and the note code NC as the stage number data of the shift registers 51C-1 through 51C-9 at which the count signals B8 through B0 regarding the note name represented by the note code NC at that time exist. When the condition is $(N2=1)\cdot(Q1=1)$, the AND gate circuit 424 produces a signal of "1" which is applied to the carry input Ci of the adder 422 so that the adder produces a sum NC+Q+1 as the stage number data. When a condition $(N2=1)\cdot(Q2=1)$ or $(N1=1)\cdot(Q2=1)$ holds, AND gate circuit 426 or 425 produces an output signal of "1", the adder 422 produces a sum NC+Q+1 as the stage number data.

The stage number data thus obtained are applied to a decoder 427, where they are decoded and outputted as note selection signals D0 through D14 corresponding to the stage number data, thereby selecting the count signals B8 through B0 regarding the note names shown by the note code NC.

As can be noted from the foregoing description, with this embodiment too, the same advantageous effect as the first embodiment of the electronic musical instrument can be obtained. Especially, according to this embodiment, there is no phase difference between musical tones of the same note names in different octave.

Figure 11:
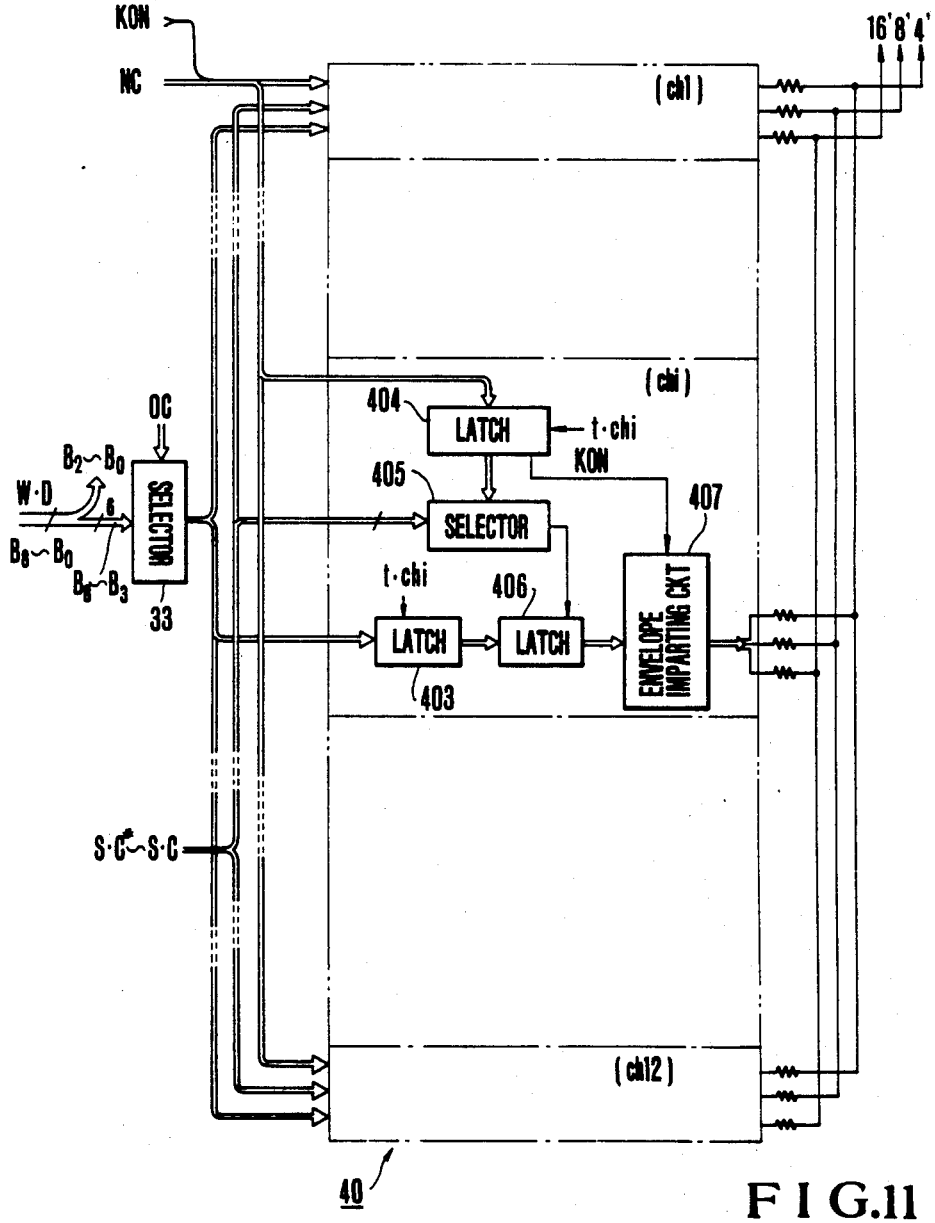
FIG. 11 is a block diagram showing another example of the output circuit of the tone generator.

FIG. 11 shows still another modification of the tone generator, particularly a modification of the output circuit shown in FIG. 5. The formation of the tone source signals of the tone production channels ch1 through ch12 according to the count of the time division counter 5 is performed on the time division basis for respective tone production channels ch1 through ch12 in synchronism with the time divisioned operation of the counter 5. In this case, since the time divisioned operation is quite independent of the frequencies (tone pitch frequencies of the keys assigned to respective channels) of the tone source signals to be formed in respective tone production channels ch1 through ch12, the tone source signals of the tone production channels ch1 through ch12 which are formed on the time division basis contain clock components so as to produce a reflected noise which distorts the musical tone or renders the same to be not clear.

For this reason, the circuit shown in FIG. 11 is constructed to overcome these problems. More particularly, the tone source signals of the tone production channels ch1 through ch12 formed on the time division basis are sampled and held at a frequency of an integer multiple of the frequency of the tone source signal of each channel so as to convert the tone source signals into continuous signals not divided on the time division basis. With this measure, it is possible to harmonize the sampling period for producing the continuous signals with the pitch of the musical tone. In practice, as a control signal for effecting the sampling and holding is used the note clock signal outputted from the first counter 1.

The output circuit of each channel shown in FIG. 11 includes a latch circuit 403 and an envelope imparting circuit 407 respectively corresponding to the latch circuit 25 and the switching circuit 27 shown in FIG. 5 and the waveform generating data regarding respective channels are stored in the latch circuit 403 according to the channel timing signals t·ch1 through t·ch12. Each circuit comprises a latch circuit 404 and a selector 405 for selecting a note clock signal corresponding to the note name of a key assigned to a given channel among the note clock signals SC# through SC. The latch circuit 404 stores a note code NC regarding a given channel among note codes of the tone production channels ch1 throgh ch12 outputted from the key assigner 2 on the time division basis according to one of the channel timing signals t·ch1 through t·ch12. The selector 405 selects a note clock signal regarding a given channel out of 12 note code signals SC# through SC according to the note code NC stored in the latch cirucit 404. The selected note code signals S (one of SC# through SC) is supplied to the latch cirucit 406 to act as a latch timing signal. The latch circit 406 is also supplied with a waveform generating data from the latch circuit 403 to be stored therein. Accordingly, the waveform generating data outputted from the latch circuit 403 are sampled and held by a note clock signal S having a frequency of an integer multiple ($2^n$) of the frequency of a musical tone signal to be produced in a given tone production channel, whereby the waveform generating data is converted into a continuous signal not containing any clock components and unwanted reflected noise components.

Signals converted into continuous signals in the output circuits of the tone production channels ch1 through ch12 in a manner described above are outputted in parallel through the envelope imparting circuit 407 as the tone source signals of 4 feets, 8 feet and 16 feet in the same manner as in FIG. 5.

Thus, it is possible to produce a musical tone clock components and unwanted reflected noise components.

As above described, according to this invention, where a plurality of frequency signals having predetermined frequencies are produced simultaneously from a plurality of frequency division channels, a counter that controls the switching of the frequency division ratio between N and N+1 in each frequency division channel is commonly used by respective frequency division channels on the time division basis. Accordingly, even when the number of the frequency division channels is large, the size of the apparatus does not increase thereby providing an electronic musical instrument of a small size.

What is claimed is:

1. In an electronic musical instrument of the type including a plurality of frequency division channels, each channel dividing a frequency of a clock pulse for producing a frequency signal having a predetermined frequency, and a musical tone is produced in accordance with said frequency signal, the improvement comprising:

a plurality of frequency dividing means each provided for each of said frequency dividion channels for dividing the frequency of said clock pulse at a frequency division ratio of N or N+1, where N is a positive integer; setting means for setting either one of the frequency division ratio N and N+1 for each of said frequency dividing means in accordance with the frequency of said frequency signal to be produced in each frequency dividion channel and for setting a combination pattern of said frequency division ratios N and N+1 in one operational cycle of each of said frequency dividing means;

time division counting means for counting, on a time division basis, a number of the frequency divided signals outputted from each of said frequency division channels as a frequency division number signal and outputting a count signal representing a count value which is said number of said frequency divided signals in one operational cycle;

control means for controlling switching the frequency division ratio of each of said frequency dividing means between N and N+1 in accordance with an information representing the combination pattern of said frequency division ratios N and N+1 regarding each of said frequency division channels and count signal regarding each of said frequency dividion channels; and means for utilizing a bit signal corresponding to a predetermined bit position of said count signal as said frequency signal.

2. An electronic musical instrument according to claim 1 wherein said information representing said combination pattern is a datum representing a number of frequency divisions at a frequency division ratio N or N+1 in one operational cycle.

3. An electronic musical instrument according to claim 2 wherein said setting means includes an output circuit for outputting, on a time division basis, a frequency division datum representing either one of frequency division ratio N and N+1 in one operational cycle of each of said frequency dividing means in synchronism with a time divisioned counting timing of said time division counting means;

said control means includes means for comparing for each frequency division channel said count value of said count signal on a time division bases with said frequency division datum, on a time division basis, for supplying on a time division basis to each of said frequency division channels a frequency division ratio control signal designating either one of said frequency division ratios, N or N+1 in accordance with said combination pattern in one operational cycle, and wherein said each frequency division channel is constituted by an input circuit which receives in synchronism with said time division timing said frequency division ratio control signal on a time division basis, a frequency division circuit which divides the frequency of said clock pulse at the designated one of said frequency division ratio N or N+1 and an output circuit for outputting a frequency divided signal outputted from said frequency division circuit in synchronism with said time division timing.

4. An electronic musical instrument according to claim 1 wherein said information representing said combination pattern comprises a datum representing the frequency division timing at a frequency division timimg N or N+1 in one operational cycle.

5. An electronic musical instrument according to claim 1 wherein said information representing said combination pattern comprises a datum showing a number of frequency division at the frequency division ratio N or N+1 in one operational cycle, and wherein the number of frequency divisions in said one operational cycle is set equally for all of said frequency division channels.

6. An electronic musical instrument according to claim 1 wherein said control means controls the switching of the frequency division ratio among respective frequency division means by uniformly arranging a frequency division timing at a frequency division ratio of a smaller number of frequency divisions in one operational cycle in a group of frequency division timings at a frequency division ratio of a larger number of frequency divisions.

7. An electronic musical instrument according to claim 5 wherein said time division counting means is constituted by a time division counter capable of counting a number larger than the number of frequency divisions in one operational cycle of each frequency division means, so as to produce frequency signals obtained by successively reducing frequencies of frequency divided output signals outputted from said frequency division means to ½, from respective bit output signals of said time division counter.

8. An electronic musical instrument according to claim 1 wherein said plurality of frequency division channels are provided corresponding to said plurality of tone production channels, and wherein said setting means sets the combination pattern of the frequency division ratio N or N+1 of said frequency division means in accordance with tone pitches of keys assigned to respective tone production channels, and of said frequency ratios N and N+1 in one operational cycle.

9. An electronic musical instrument according to claim 1 wherein each of said frequency division channels is provided for each one of 12 note names, and wherein said setting means sets a combination pattern of the frequency division ratio N or N+1 of each frequency division means and of said frequency division ratios N and N+1 in one frequency division cycle, corresponding to each note name.

10. In an electronic musical instrument of the type including a plurality of tone production channels corresponding to maximum numbers of tones which may be produced simultaneously and producing a musical tone by assigning a musical tone regarding a depressed key to one of said tone production channels, the improvement comprising:

arithmetic operation means for forming waveform generating data for respective note names each constituted by a plurality of bits, said waveform generating data being respectively formed every predetermined common sampling period unrelated to respective note names;

note name selection means for respectively deriving out, for respective tone production channels, waveform generating data corresponding to the note names of the keys assigned to said tone production channels from the waveform generating data for respective note names formed by said arithmetic operation means;

octave control means for controlling said waveform generating data of respective tone production channels outputted from said note name selection means in accordance with octave note regions of the keys assigned to respective tone production channels;

waveform data generating means for producing, on a time division basis, musical tone waveform data for respective channels based on the waveform generating data for respective tone production channels outputted from said octave control means;

amplitude setting means for setting, on a time division basis, amplitudes based on desired envelope data for musical tone waveform data of respective tone production channels produced by said waveform generating means;

sampling and holding means for sampling and holding said musical tone waveform data of respective tone production channels every sampling periods corresponding to the pitches of tones to be produced respectively, said musical tone waveform data having been set respectively with said amplitudes, according to predetermined bits of said waveform generating data regarding the same note names as said musical tone forming data; and means for producing outputs of said sampling and holding means as musical tones of respective tone production channels.

11. An electronic musical instrument according to claim 10 wherein said sampling and holding means are provided respectively for said plurality of tone production channels, each sampling and holding means for each tone production channel comprises a first latch circuit for latching a musical tone waveform datum outputted from said amplitude setting means of said each tone production channel, and a second latch circuit for latching the musical tone waveform datum outputted from said first latch circuit in accordance with a predetermined bit signals of said waveform generating data regarding the same note name as said musical tone waveform datum.

12. An electronic musical instrument according to claim 10 wherein said octave control means comprise a circuit that shifts bit positions of said waveform generating data toward the most significant bit side or the least significant bit side.

13. An electronic musical instrument comprising:

clock pulse generating means for generating clock pulses;

a plurality of tone production channels, each of which includes frequency dividing means with an output pulse made by dividing the frequency of said clock pulses at a frequency division ratio of either one of N and N+1, where N is a positive integer;

time division counting means for counting, on a the time division basis, said output pulses outputted from said frequency dividing means; and control means for determining, on the time a division basis, the frequency division ratios of said frequency dividing means in accordance with the counted values of said time division counting means, whereby each of said tone production channels individually produces a tone signal having a frequency determined by a combination pattern of N and N+1.

14. An electronic keyboard musical instrument having a plurality of tone production channels comprising:

assigning means for assigning note information of a depressed key respectively to an available one among said plurality of tone production channels;

frequency signal generating means for generating twelve frequency signals having frequencies corresponding to twelve note names;

phase signal generating means receiving said frequency signals for generating, on time division basis, phase signals having values corresponding to phase angles of twelve notes corresponding to said twelve note names;

selecting means for selecting the phases signal corresponding to said assigned note information among said phase signals, the selected phase signal being a signal having a value corresponding to a phase angle of a note to be produced corresponding to said depressed key; and musical tone forming means for forming a musical tone in accordance with said selected phase signal.

15. An electronic keyboard musical instrument according to claim 14 wherein said phase signal generating means is constructed by time division counting means for counting, on a time division basis, the numbers of said frequency signals respectively and for outputting the counted values as said phase values of said phase signals.

16. An electronic keyboard musical instrument according to claim 14 further comprising:

memory means for storing a musical tone waveshape and for outputting said musical tone waveshape in accordance with said selected phase signal.

17. An electronic keyboard musical instrument according to claim 14 further comprises shifting means and wherein said note information comprises note name information respresenting note name and octave information representing octave of said depressed key respectively, said selecting means selects said phase signal corresponding to said note name information, and said shifting means shifts said selected phase signal toward the least significant bit side in accordance with said octave informaiton, said shifted phase signal being said signal representing phase value of a note to be produced corresponding to said depressed key.

18. An electronic musical instrument comprising:

frequency dividing means for dividing a frequency of a clock pulse at a frequency division ratio of N or N+1, where N is a positive integer;

means for setting the frequency division ratio N or N+1 in accordance with a frequency of a frequency signal to be produced and for setting a combination pattern of said frequency division ratios N and N+1;

time division counting means for counting, on a time division basis, a number of said frequency divided signals outputted from said frequency dividing means;

control means for controlling switching the frequency division ratios between N and N+1 in accordance with an information representing the combination pattern of said frequency division ratios N and N+1 set by said setting means; and musical tone production means for producing, on the time division basis, a musical tone in accordance with count values of said time division counting means.

19. An electronic musical instrument including tone production channels whose number is equal to that of tones to be produced simultaneously, comprising:

note selection means for selecting one or more musical notes for tone production;

phase angle information generating means for concurrently, continuously and individually generating twelve phase angle informations respectively representing progressing phase angle values of notes of twelve note names, said generating means continuously and individually generating said twelve phase angle informations representing progressive phase angle values regardless of whether any note has been selected for tone production by said selection means;

assigning means for assigning note information corresponding to a selected note to an available one among said tone production channels;

selecting means for continually selecting for each channel the phase angle information corresponding to said note information assigned to that channel; and musical tone forming means for forming for a duration of time a musical tone of a note corresponding to said assigned note information by utilizing said continually selected phase angle information throughout said duration of musical tone formation, the phase angle value of said musical tone being determined by said selected phase angle information.

20. An electronic musical instrument including tone production channels whose number is equal to that of tones to be produced simultaneously, comprising:

phase angle information generating means for concurrently, continuously and individually generating tweleve phase angle informations respectively representing progressing phase angle values of notes of twelve note names;

assigning means for assigning note information corresponding to a depressed key to an available one among said tone production channels;

selecting means for continually selecting for each channel the phase angle information corresponding to said note information assigned to that channel;

musical tone forming means for forming for a duration of time a musical tone of a note corresponding to said assigned note information by utilizing said continually selected phase angle throughout said duration of musical tone formation, the phase angle value of said musical tone being determined by said selected phase angle information; and wherein:

said generating means continuously and individually generates said twelve phase angle informations representing progressive phase angle values regardless of whether any assignment has been made by said assigning means.

* * * * *